US009328692B2

(12) United States Patent
Rado et al.

(10) Patent No.: US 9,328,692 B2
(45) Date of Patent: May 3, 2016

(54) OPPOSED PISTON ENGINES WITH CONTROLLED PROVISION OF LUBRICANT FOR LUBRICATION AND COOLING

(75) Inventors: Gordon E. Rado, Carlsbad, CA (US); Louis F. Medeiros, Oceanside, CA (US)

(73) Assignee: ACHATES POWER, INC., San Diego, CA (US)

( * ) Notice: Subject to any disclaimer, the term of this patent is extended or adjusted under 35 U.S.C. 154(b) by 1086 days.

(21) Appl. No.: 12/658,697

(22) Filed: Feb. 12, 2010

(65) Prior Publication Data

US 2010/0212638 A1 Aug. 26, 2010

Related U.S. Application Data

(60) Provisional application No. 61/208,136, filed on Feb. 20, 2009, provisional application No. 61/209,912, filed on Mar. 11, 2009.

(51) Int. Cl.

| | |
|---|---|
| ***F01M 1/02*** | (2006.01) |
| ***F02F 1/18*** | (2006.01) |
| ***F01B 7/14*** | (2006.01) |
| ***F01M 1/08*** | (2006.01) |
| ***F01M 11/02*** | (2006.01) |

(Continued)

(52) U.S. Cl.

CPC . *F02F 1/186* (2013.01); *F01B 7/14* (2013.01); *F01M 1/08* (2013.01); *F01M 11/02* (2013.01); *F02B 75/282* (2013.01); *F01M 5/007* (2013.01); *F01M 2001/066* (2013.01)

(58) Field of Classification Search

CPC ..... F01M 11/02; F01M 2011/022; F01M 2011/027; F01M 2011/026; F02B 75/24

USPC ..... 123/196 R, 51 R, 41.34, 41.35, 51 BA, 123/67, 197.4, 193.4, 52.2, 41.72, 193.2, 123/41.02, 41.44, 41.82 R, 53.3, 55.5; 184/104.2, 6.8; 418/88, 91, 94

See application file for complete search history.

(56) References Cited

U.S. PATENT DOCUMENTS

| | | | |
|---|---|---|---|
| 1,231,903 | A | 7/1917 | Junkers |
| 1,410,319 | A | 3/1922 | Junkers |

(Continued)

FOREIGN PATENT DOCUMENTS

| | | | |
|---|---|---|---|
| DE | 199 62 325 | A1 | 7/2001 |
| EP | 0747591 | A1 | 12/1996 |

(Continued)

OTHER PUBLICATIONS

J.F. Butler, E.P. Crowdy; *The Doxford Seahorse Engine*, paper presented at a joint meeting of the Institute and N.E.C.I.E.S. on Nov. 8-9, 1971 pp. 73-115.

(Continued)

*Primary Examiner* — Lindsay Low
*Assistant Examiner* — Omar Morales
(74) *Attorney, Agent, or Firm* — Terrance A. Meador

(57) ABSTRACT

In multi-cylinder opposed engine constructions provision of lubricant for lubricating bearings, for cooling cylinders, and for cooling pistons includes pumping an inlet stream of lubricant through a gallery in the engine that is in fluid communication with bearing lubricant passages and cylinder coolant passages and providing lubricant from the inlet stream of lubricant into at least one piston coolant manifold in response to a first engine operating condition.

20 Claims, 28 Drawing Sheets

(51) Int. Cl.

| | |
|---|---|
| ***F02B 75/28*** | (2006.01) |
| *F01M 5/00* | (2006.01) |
| *F01M 1/06* | (2006.01) |

(56) References Cited

U.S. PATENT DOCUMENTS

| | | | | |
|---|---|---|---|---|
| 1,495,326 | A | 5/1924 | Junkers | |
| 1,683,040 | A | 9/1928 | Junkers | |
| 1,796,603 | A | 3/1931 | Junkers | |
| 1,808,380 | A | 6/1931 | Royal | |
| 1,818,558 | A | 9/1931 | Junkers | |
| 1,892,277 | A | 12/1932 | Junkers | |
| 1,956,355 | A | 4/1934 | Junkers | 309/33 |
| 2,031,318 | A | 2/1936 | Junkers | 123/51 |
| 2,244,323 | A | 6/1941 | Antonsen et al. | 123/173 |
| 2,374,460 | A | 4/1945 | Rossman | 123/51 BB |
| 2,398,640 | A | 4/1946 | Hickey | 123/48 B |
| 2,423,395 | A | 7/1947 | Lieberherr | 123/173 |
| 2,653,484 | A | 9/1953 | Zecher | 74/40 |
| 2,788,773 | A | 4/1957 | Meurer | 123/41.35 |
| 3,023,743 | A | 3/1962 | Schauer | 123/51 |
| 3,065,743 | A | 11/1962 | Brehm | 123/41.35 |
| 3,182,642 | A | 5/1965 | Drtina | 123/41.35 |
| 3,209,736 | A | 10/1965 | Witzky | 123/48 R |
| 3,221,718 | A | 12/1965 | Isley | 123/32 |
| 3,369,530 | A | 2/1968 | Campbell | 123/6 |
| 3,534,715 | A | 10/1970 | Antonsen et al. | 123/41.79 |
| 3,777,722 | A | 12/1973 | Lenger | 123/46 |
| 3,983,793 | A | 10/1976 | Beardmore | 92/190 |
| 4,010,718 | A | 3/1977 | Stewart | 123/41.35 |
| 4,180,027 | A | 12/1979 | Taylor | 123/41.35 |
| 4,204,487 | A | 5/1980 | Jones | 123/41.35 |
| 4,508,065 | A | 4/1985 | Suchdev | 123/41.35 |
| 4,794,896 | A | 1/1989 | Tsai et al. | 123/193 |
| 4,843,952 | A | 7/1989 | Ripberger | 92/190 |
| 5,058,536 | A * | 10/1991 | Johnston | 123/51 BA |
| 5,058,537 | A | 10/1991 | Paul et al. | 123/51 |
| 5,355,854 | A | 10/1994 | Aubee | 123/431 |
| 5,442,993 | A | 8/1995 | Baliotti et al. | 92/84 |
| 5,533,472 | A | 7/1996 | Sands et al. | 123/41.35 |
| 5,806,631 | A | 9/1998 | Yoshida et al. | 184/18 |
| 5,826,556 | A | 10/1998 | Ruman et al. | 123/196 |
| 5,915,345 | A | 6/1999 | Kling et al. | 123/41.35 |
| 6,170,443 | B1 | 1/2001 | Hofbauer | 123/51 B |
| 6,182,619 | B1 | 2/2001 | Spitzer et al. | 123/51 |
| 6,276,260 | B1 | 8/2001 | Bianchi | 92/187 |
| 6,481,389 | B2 | 11/2002 | Suzuki et al. | 123/41.35 |
| 6,715,457 | B1 | 4/2004 | Shoptaw et al. | 123/193.6 |
| 7,156,056 | B2 * | 1/2007 | Lemke et al. | 123/41.35 |
| 7,207,299 | B2 | 4/2007 | Hofbauer | 123/46 E |
| 7,210,399 | B2 | 5/2007 | Ioja | 92/216 |
| 7,255,070 | B2 | 8/2007 | Hofbauer | 123/46 R |
| 7,360,511 | B2 | 4/2008 | Lemke et al. | 123/41.35 |
| 7,383,796 | B2 | 6/2008 | Hofbauer | 123/46 R |
| 7,434,550 | B2 | 10/2008 | Hofbauer | 123/51 R |
| 7,469,664 | B2 | 12/2008 | Hofbauer et al. | 123/54.1 |
| 7,509,937 | B2 | 3/2009 | Hofbauer | 123/196 R |
| 7,546,819 | B2 | 6/2009 | Lemke et al. | 123/41.35 |
| 7,549,401 | B2 * | 6/2009 | Lemke et al. | 123/41.34 |
| 7,578,267 | B2 | 8/2009 | Hofbauer et al. | 123/51 BC |
| 7,591,235 | B2 | 9/2009 | Lemke et al. | 123/41.35 |
| 7,735,834 | B2 | 6/2010 | Hofbauer | 277/438 |
| 2004/0011308 | A1 | 1/2004 | Hausler et al. | 123/73 |
| 2004/0221823 | A1 | 11/2004 | Warren | 123/45 |
| 2005/0274332 | A1 | 12/2005 | Lemke et al. | 123/41.35 |
| 2006/0102131 | A1 | 5/2006 | Han | 123/193.4 |
| 2006/0124084 | A1 * | 6/2006 | Hofbauer et al. | 123/55.7 |
| 2006/0157003 | A1 * | 7/2006 | Lemke et al. | 123/41.38 |
| 2007/0039572 | A1 | 2/2007 | Lemke et al. | 123/51 BB |
| 2007/0245892 | A1 | 10/2007 | Lemke et al. | 92/169.1 |
| 2008/0017164 | A1 * | 1/2008 | Hofbauer | 123/196 R |
| 2008/0035101 | A1 | 2/2008 | Hausler et al. | 123/196 |
| 2008/0041346 | A1 | 2/2008 | Hofbauer | 123/51 BC |
| 2008/0127947 | A1 | 6/2008 | Hofbauer | 123/51 BC |
| 2008/0163848 | A1 | 7/2008 | Lemke et al. | 123/197.3 |
| 2008/0314688 | A1 | 12/2008 | Lemke et al. | 184/6.8 |
| 2009/0151663 | A1 | 6/2009 | Pastor | 123/68 |
| 2009/0183491 | A1 | 7/2009 | Hofbauer | 60/39.52 |
| 2010/0212613 | A1 * | 8/2010 | Lemke et al. | 123/52.2 |
| 2010/0212637 | A1 * | 8/2010 | Lemke et al. | 123/51 R |
| 2010/0229836 | A1 * | 9/2010 | Hofbauer et al. | 123/51 R |

FOREIGN PATENT DOCUMENTS

| | | | |
|---|---|---|---|
| EP | 2053219 | A1 | 4/2009 |
| GB | 5941 AD 1913 | | 0/1914 |
| GB | 10974 AD1914 | | 5/1918 |
| GB | 147733 | | 2/1921 |
| GB | 173226 | | 1/1923 |
| GB | 348084 | | 4/1931 |
| GB | 520351 | | 4/1940 |
| GB | 558 115 | | 12/1943 |
| GB | 779 631 | A | 7/1957 |
| WO | WO 00/28194 | A1 | 5/2000 |
| WO | WO 01/50042 | A1 | 7/2001 |
| WO | WO 03/060355 | A1 | 7/2003 |
| WO | WO 2005/103456 | A2 | 11/2005 |
| WO | WO 2005/124124 | A1 | 12/2005 |
| WO | WO 2007/109122 | A2 | 9/2007 |
| WO | WO 2008/016289 | A1 | 2/2008 |

OTHER PUBLICATIONS

J. K. Parker, S. R. Bell, D. M. Davis;*An Opposed Piston Diesel Engine*, ICE vol. 18, New Developments in Off-Highway Engines, ASME 1992, pp. 17-24.

J. C. McLanahan, Salem State College; *Diesel Aircraft Engine: A Delayed Promise from the 1930's*, SAE International and American Institute if Aeronautics, 1999-01-5583, pp. 1-10.

International Search Report and Written Opinion of the ISA, PCT/US2005/020553, mailed Nov. 24, 2005.

International Preliminary Report on Patentability, PCT/US2007/006618, mailed Feb. 1, 2008.

Partial International Search Report, PCT/US2010/00492, mailed Jun. 24, 2010.

English Translation of First Office Action in PRC application 200580023840.9, mailed Jul. 25, 2008.

First Examination Report in EP application 05757692.8, mailed Sep. 5, 2008.

Applicant's response to the first Examination Report in EP application 05757692.8, submitted Dec. 18, 2008.

* cited by examiner

OPPOSED PISTON ENGINES WITH CONTROLLED PROVISION OF LUBRICANT FOR LUBRICATION AND COOLING

PRIORITY

This application claims priority to U.S. Provisional Application for Patent 61/208,136, filed Feb. 20, 2009 and to U.S. Provisional Application for Patent 61/209,912, filed Mar. 11, 2009, both commonly assigned herewith.

RELATED APPLICATIONS

This application contains subject matter related to the subject matter of the following patent applications:

U.S. patent application Ser. No. 10/865,707, filed Jun. 10, 2004 for "Two Cycle, Opposed Piston Internal Combustion Engine", published as US/2005/0274332 on Dec. 15, 2005, now U.S. Pat. No. 7,156,056, issued Jan. 2, 2007;

PCT application US2005/020553, filed Jun. 10, 2005 for "Improved Two Cycle, Opposed Piston Internal Combustion Engine", published as WO/2005/124124 on Dec. 29, 2005;

U.S. patent application Ser. No. 11/095,250, filed Mar. 31, 2005 for "Opposed Piston, Homogeneous Charge Pilot Ignition Engine", published as US/2006/0219213 on Oct. 5, 2006, now U.S. Pat. No. 7,270,108, issued Sep. 18, 2007;

PCT application US/2006/011886, filed Mar. 30, 2006 for "Opposed Piston, Homogeneous Charge, Pilot Ignition Engine", published as WO/2006/105390 on Oct. 5, 2006;

U.S. patent application Ser. No. 11/097,909, filed Apr. 1, 2005 for "Common Rail Fuel Injection System With Accumulator Injectors", published as US/2006/0219220 on Oct. 5, 2006, now U.S. Pat. No. 7,334,570, issued Feb. 26, 2008;

PCT application US/2006/012353, filed Mar. 30, 2006 "Common Rail Fuel Injection System With Accumulator Injectors", published as WO/2006/107892 on Oct. 12, 2006;

U.S. patent application Ser. No. 11/378,959, filed Mar. 17, 2006 for "Opposed Piston Engine", published as US/2006/0157003 on Jul. 20, 2006, now U.S. Pat. No. 7,360,511, issued Apr. 22, 2008;

PCT application PCT/US2007/006618, filed Mar. 16, 2007 for "Opposed Piston Engine", published as WO 2007/109122 on Sep. 27, 2007;

U.S. patent application Ser. No. 11/512,942, filed Aug. 29, 2006, for "Two Stroke, Opposed-Piston Internal Combustion Engine", published as US/2007/0039572 on Feb. 22, 2007;

U.S. patent application Ser. No. 11/629,136, filed Jun. 10, 2005, for "Two-Cycle, Opposed-Piston Internal Combustion Engine", published as US/2007/0245892 on Oct. 25, 2007;

U.S. patent application Ser. No. 11/642,140, filed Dec. 20, 2006, for "Two Cycle, Opposed Piston Internal Combustion Engine";

U.S. patent application Ser. No. 11/725,014, filed Mar. 16, 2007, for "Opposed Piston Internal Combustion Engine With Hypocycloidal Drive and Generator Apparatus";

U.S. patent application Ser. No. 12/075,374, filed Mar. 11, 2008, for "Opposed Piston Engine With Piston Compliance", published as US/2008/0163848 on Jul. 10, 2008; and, U.S. patent application Ser. No. 12/075,557, filed Mar. 12, 2008, for "Internal Combustion Engine With Provision for Lubricating Pistons".

BACKGROUND

The field includes internal combustion engines. More particularly, the field includes opposed piston engines. More particularly still, the field includes opposed piston engines with a plurality of cylinders, or multi-cylinder opposed piston engines.

In an opposed piston engine, each cylinder has two ends and two pistons, with a piston disposed in each end. An inlet port is machined or formed in one end ("the inlet end") of the cylinder, and an exhaust port in the other end ("the exhaust end"). An opposed piston engine may have one or more crankshafts and/or other outputs and may use a variety of fuels. In a typical opposed piston engine, an air-fuel mixture is compressed in the cylinder bore between the crowns of the pistons as they move toward each other. The heat resulting from compression causes combustion of the air-fuel mixture as the pistons near respective top dead center (TDC) positions in the middle of the cylinder. Expansion of gases produced by combustion drives the opposed pistons apart, toward respective bottom dead center (BDC) positions near the ports. Movements of the pistons are phased in order to control operations of the inlet and exhaust ports during compression and power strokes. Advantages of opposed piston engines include efficient scavenging, high thermal and mechanical efficiencies, simplified construction, and smooth operation. See *The Doxford Seahorse Engine*, J F Butler, et al., Trans. I. Mar. Eng., 1972, Vol. 84.

Recent technology designs described in the cross-referenced patent applications have improved many aspects of opposed piston engine construction and operation. For example, novel cooling designs focus on the thermal profiles exhibited by engine power components during engine operation. In this regard, tailored cooling effectively compensates for the longitudinally asymmetrical thermal signatures exhibited by cylinders during engine operation, while the opposed pistons are cooled by radially symmetrical application of coolant to the backs of their crowns. Cylinder construction is simplified by limiting cylinder liner length, which allows pistons to be substantially withdrawn and their skirts to be lubricated during engine operation. This design reduces welding and increases the power-to-weight ration of the engine. In order to reduce side forces on the pistons, no linkage pins (also called wristpins and gudgeon pins) are mounted within or upon the pistons.

Nevertheless, there is a need to integrate recent technological advances with additional improvements in multi-cylinder opposed piston engine constructions in order to further enhance the power-to-weight ratio, durability, adaptability, and compactness, and thereby increase the range of use, of such engines.

SUMMARY

Accordingly, the engine constructions described in this specification include certain improvements in an integrated, multi-cylinder engine design including a unitary engine support structure to which cylinder liners are mounted secured, and sealed, and on which crankshafts are rotatably supported. Cylinder liners are decoupled from exhaust, air intake, and cooling components, and pressurized air is provided to all cylinders in a single input plenum.

An opposed piston engine construction is constituted of a spar with a lengthwise dimension and a plurality of through bores transverse to the lengthwise dimension. A first lubricant distribution gallery extends generally lengthwise in the top of the spar with lubricant feed passages extending through the spar to the top main bearings. A second lubricant distribution gallery extends generally lengthwise in the bottom of the spar with coolant feed passages extending through the spar to coolant channels between the through bores and the cylinder liners and lubricant feed passages extending through the spar to the bottom main bearings. A pumped lubricant source is connected to provide a flow of lubricant to the first and second lubricant distribution galleries.

Provision of lubricant for lubricating bearings, for cooling cylinders, and for cooling pistons in an opposed piston engine includes pumping an inlet stream of lubricant through a gallery in the engine that is in fluid communication with bearing lubricant passages and cylinder coolant passages and providing lubricant from the inlet stream of lubricant into at least one piston coolant manifold in response to a first engine operating condition.

DETAILED DESCRIPTION OF THE PREFERRED EMBODIMENTS

Constructions of a multi-cylinder, opposed piston engine are described and illustrated. Although the engine constructions include four cylinders, this configuration is intended to illustrate a representative embodiment, and should not limit the principles presented in this specification only to four-cylinder opposed piston engines.

Figure 1A:
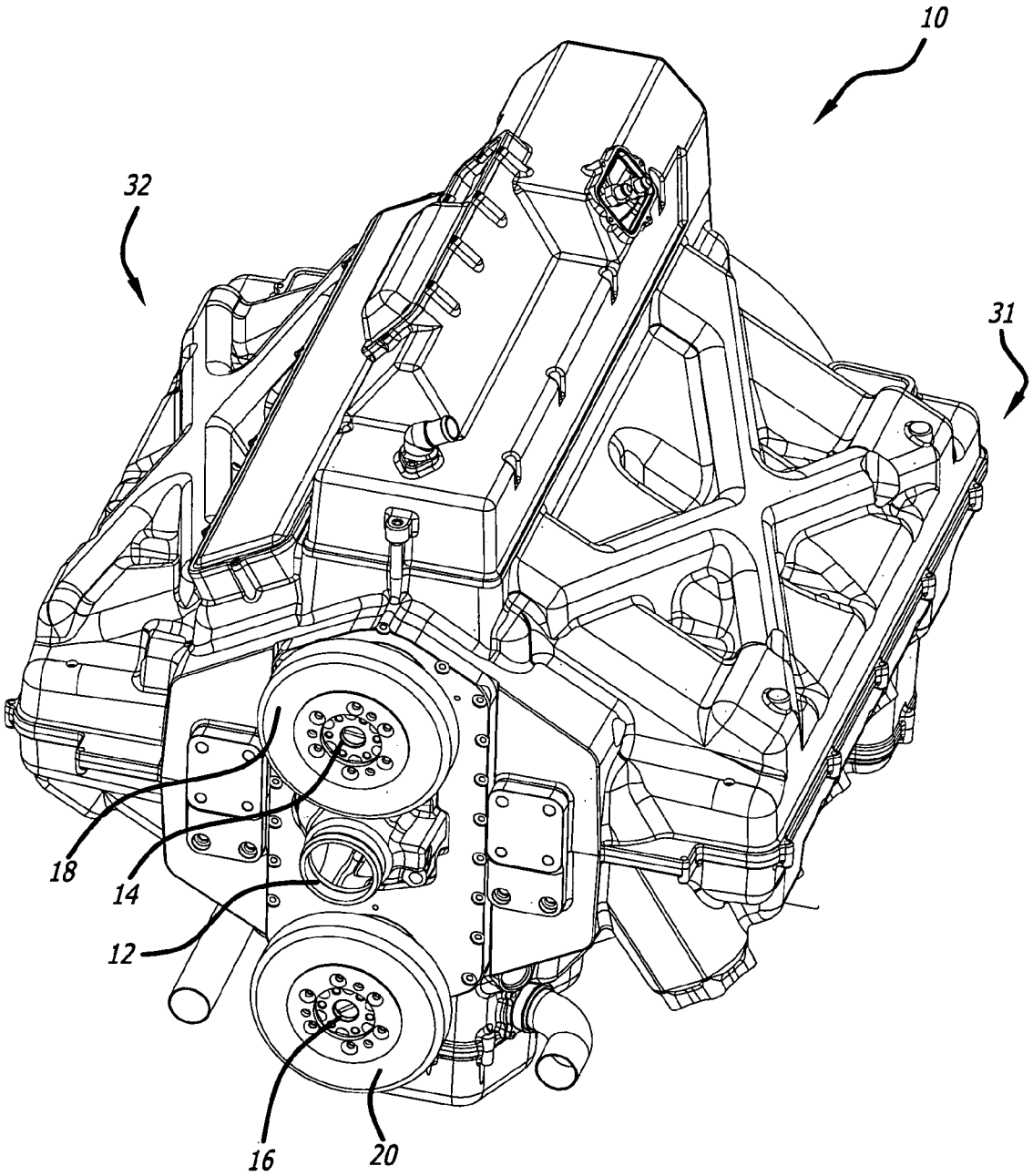
FIG. 1A is a perspective view of a multi-cylinder opposed piston engine constructed according to this specification.

FIG. 1A, is a perspective view, looking toward a first end of a multi-cylinder opposed piston engine 10. The engine includes an air inlet adapter 12 and two crankshafts 14, 16 with dampers 18, 20 mounted to their respective corresponding ends. Engine exhaust is collected along a first side 31 of the engine 10, and pressurized inlet air is distributed along a second side 32.

Figure 1B:
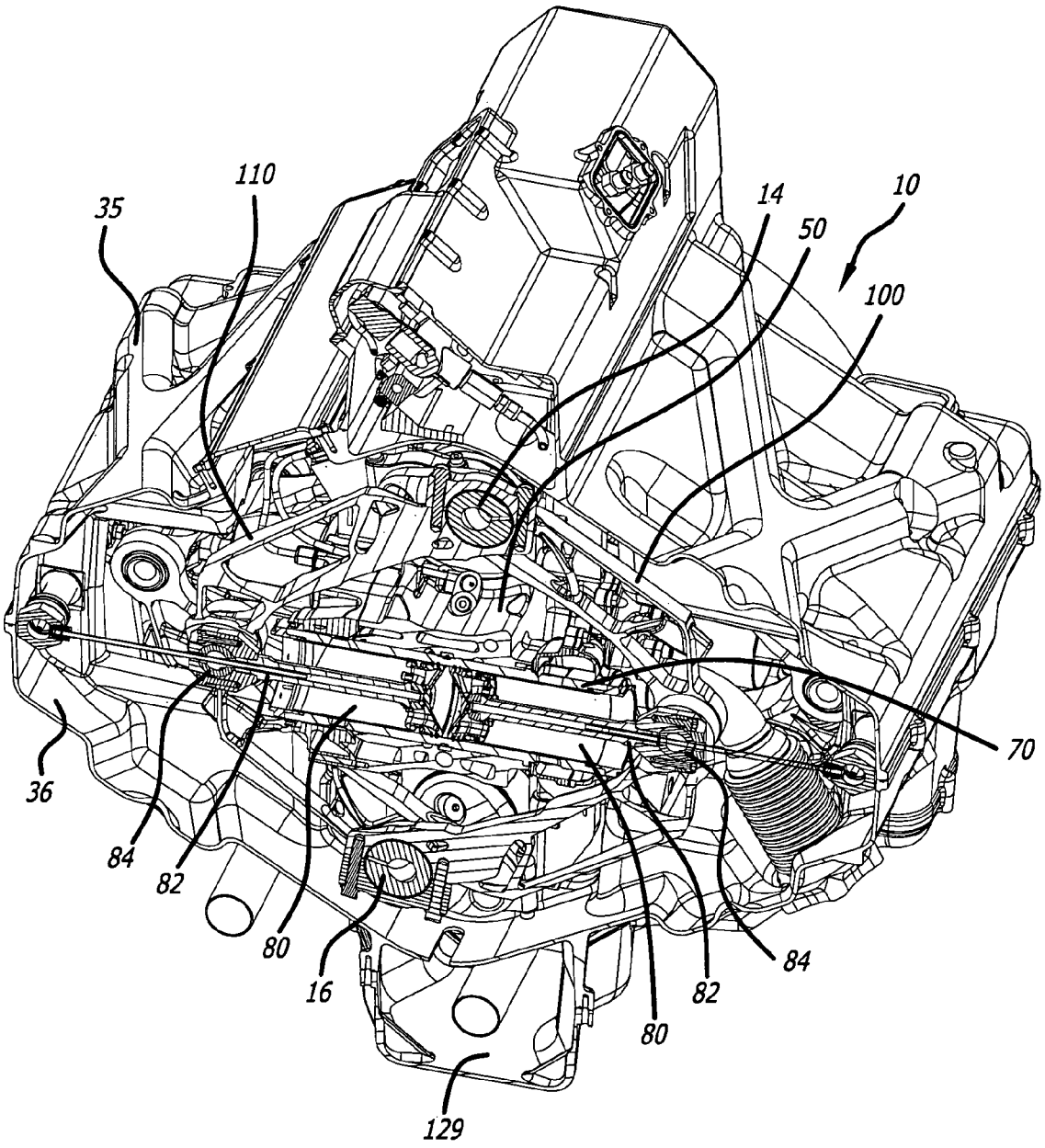
FIG. 1B is a perspective cross section of the engine of FIG. 1A taken transversely and perpendicularly to a longitudinal axis of the engine.
Figure 1C:
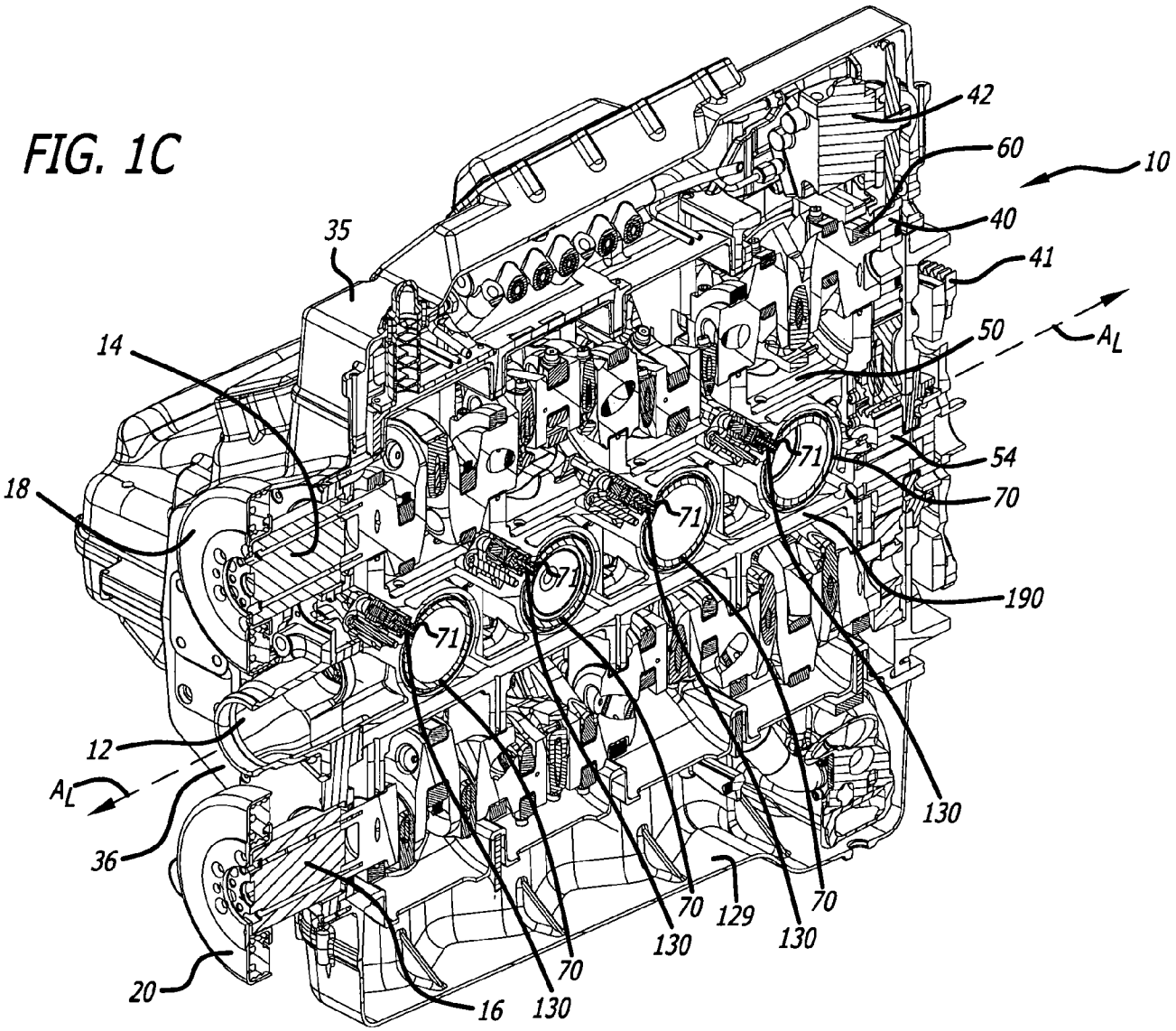
FIG. 1C is a perspective vertical cross section of the engine of FIG. 1A taken along the longitudinal axis of the engine of FIG. 1A.

As seen in FIGS. 1B and 1C, the housing of the engine 10 includes an upper cover 35 and a lower cover 36. The engine 10 has a generally lengthwise dimension along a longitudinal axis $A_l$ (FIG. 1B), and includes an elongate longitudinal member, or spar, 50 that supports components of the engine, including the crankshafts 14, 16, an output drive train 40, a flywheel 41, various auxiliary equipment (including a fuel pump 42), and cylinder liners (also referred to as "sleeves") 70. The cylinder liners 70 are disposed side by side, in a spaced parallel relationship oriented generally transversely to the longitudinal axis $A_l$. Two opposed pistons 80 are supported for reciprocal movement in the bore of each cylinder liner 70, toward and away from each other. Each piston 80 has a piston rod 82 fixed at one end to the back surface of the piston's crown, and coupled at the other end by a linking pin 84 to connecting rods 100, 110. Each piston is coupled or linked by two connecting rods 100 to one crankshaft and by one connecting rod 110 to the other crankshaft. The connecting rods 100, 110 are cabined by the engine housing for reciprocal movement therein. The crankshafts 14, 16 are rotatably disposed in a spaced, parallel relationship by main bearings 60 mounted in longitudinal alignment along opposing top and bottom surfaces of the spar 50. With the crankshafts 14, 16 mounted in this fashion, their longitudinal axes lie in a plane that intersects the cylinder liners 70 and is perpendicular to the axes of the bores in the cylinder liners 70. The covers 35 and 36 form an engine enclosure within which lubricant is thrown and splashed by moving parts of the engine. A sump 129 on the bottom of the engine 10 collects oil for recirculation to the engine. In this description, the crankshaft 14 is referred to as the upper crankshaft, and the crankshaft 16 is the lower crankshaft.

Figure 1D:
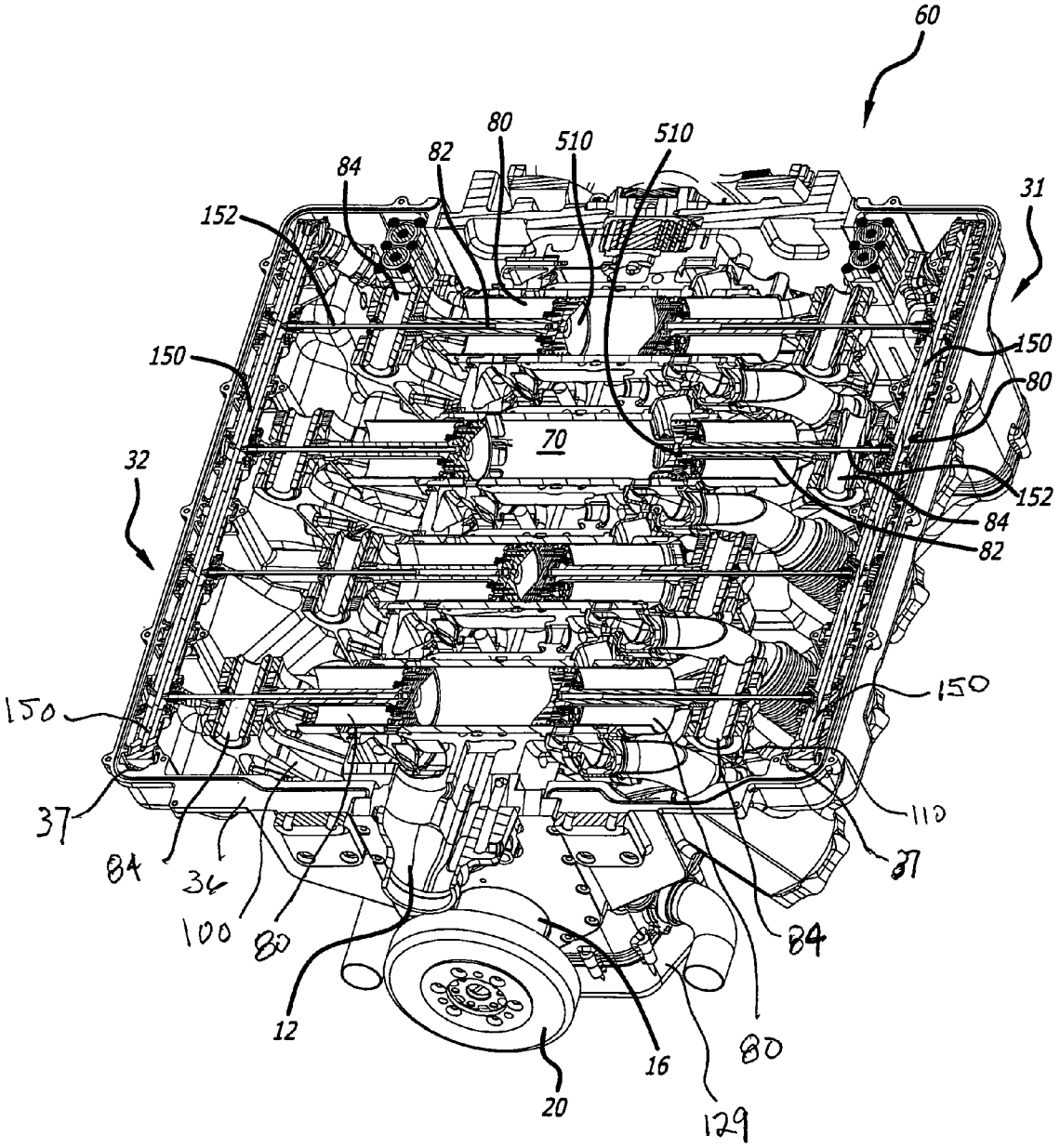
FIG. 1D is a perspective horizontal cross section of the engine of FIG. 1A taken along the longitudinal axis of the engine of FIG. 1A.

Refer now to FIG. 1C. The four cylinder liners 70 are supported in the spar 50, as are four fuel injectors 130, each mounted in a downwardly angled injector bore 131 through the top surface of the spar to a respective through bore 54. An injection port 71 through the side of each cylinder liner 70 receives the nozzle tip of a fuel injector 130. Preferably, the injection port 71 is positioned substantially at the longitudinal midpoint of the cylinder liner 70, so as to provide fuel under pressure into the combustion space in the bore of the cylinder liner when the pistons are at or near top dead center during engine operation. As per FIG. 1D, piston coolant manifolds 150 are supported on the insides of the engine covers, with one manifold extending along the engine within the first side 31 and the other manifold extending along the engine within the second side 32. Each piston coolant manifold 150 includes four piston coolant jets 152, each of which extends laterally from the manifold through sliding couplings in a respective linking pin 84 to deliver coolant into the bore of an associated piston rod 82 for cooling the associated piston 80. In order not to interfere with piston movement, each jet 152 is fixed only to the piston coolant manifold 150 from which it extends; but is not fixed to the piston to which it provides coolant.

Figure 2A:
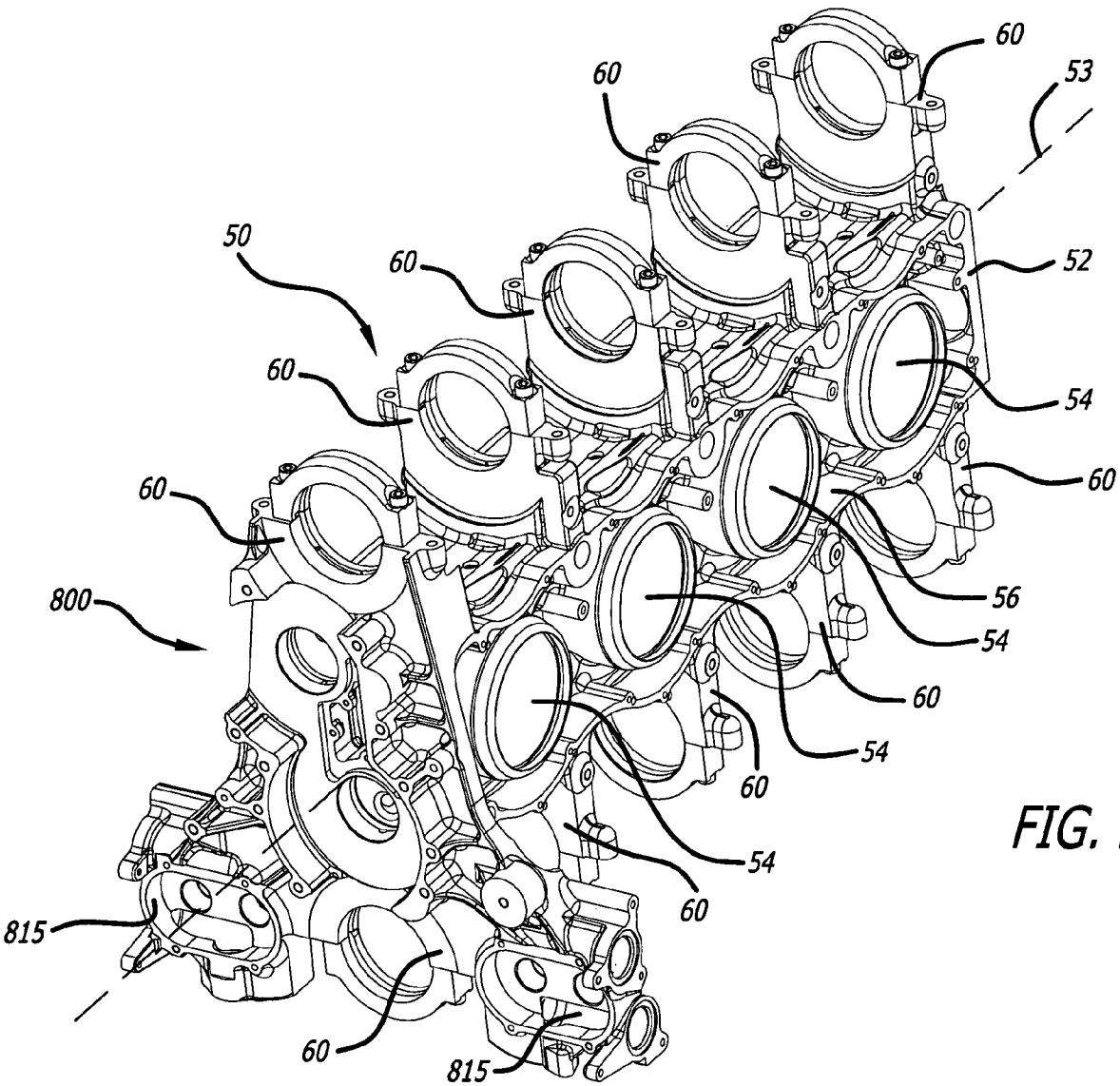
FIG. 2A is a perspective view of a longitudinal member, or spar, of the engine of FIG. 1A looking toward a first side of a drive train support structure.

The spar 50, best seen in FIG. 2A, is the principal support element of the engine 10. Preferably, the spar is cast from a high strength, lightweight aluminum alloy. Certain preformed elements such as tubes may be incorporated into the spar structure during casting to provide passages and galleys. Once cast, the spar may then be machined to fill out and complete its basic structure. The cast and machined spar preferably comprises through bores to support cylinder liners, an intake plenum, main bearing pedestals, a drive train support structure, and various galleries, passageways, and bores.

Figure 2B:
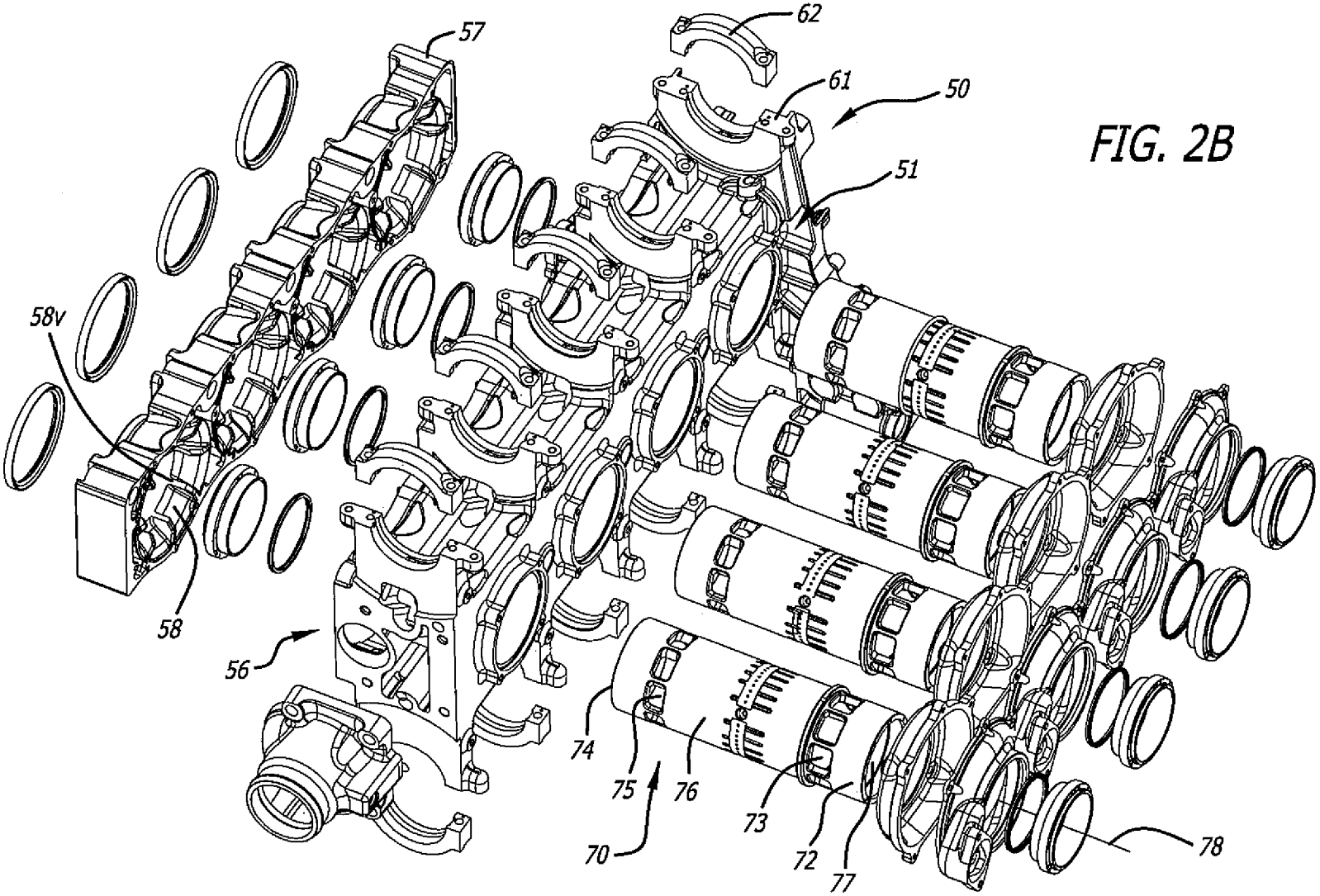
FIG. 2B is an exploded perspective view of elements of the engine positioned with respect to one side of the spar of FIG. 2A.
Figure 2C:
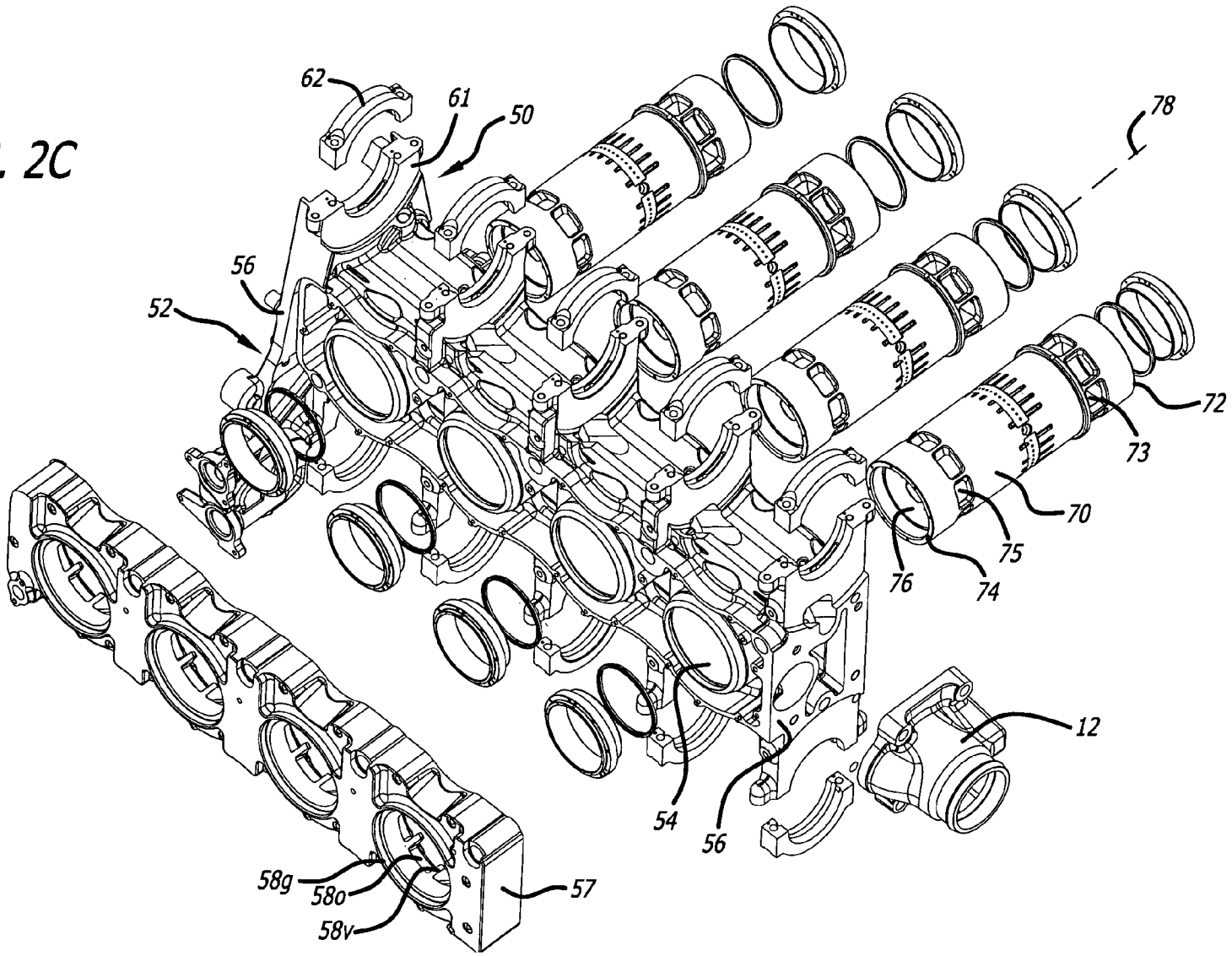
FIG. 2C is the exploded perspective view of the elements shown in FIG. 2B positioned with respect to another side of the spar of FIG. 2A.

Referring now to FIGS. 2A, 2B and 2C, the spar 50 has first and second sides 51 and 52, a lengthwise dimension 53, and through bores 54 transverse to the lengthwise direction. The through bores 54 are disposed side by side in a spaced, parallel relationship, with their axes extending between the first and second sides of the engine. The air inlet adapter 12 is mounted to the spar 50 in fluid communication with an air intake ("inlet") plenum 56 along the second side 52. The inlet plenum 56 is constituted of an elongate trench formed in the second side 52 of the spar 50 into which inlet ends of the through bores 54 protrude. Two sets of main bearing assemblies 60 are mounted along the lengthwise dimension on opposing top and bottom surfaces of the spar 50, which correspond respectively to the top and bottom of the engine. The main bearings 60 of each set are aligned lengthwise with each other on their respective surface. Each main bearing assembly has a pedestal 61 preferably formed as a part of the spar casting, and a removable outer bearing piece 62 attached by threaded screws or bolts to each main bearing pedestal 61.

Figure 2D:
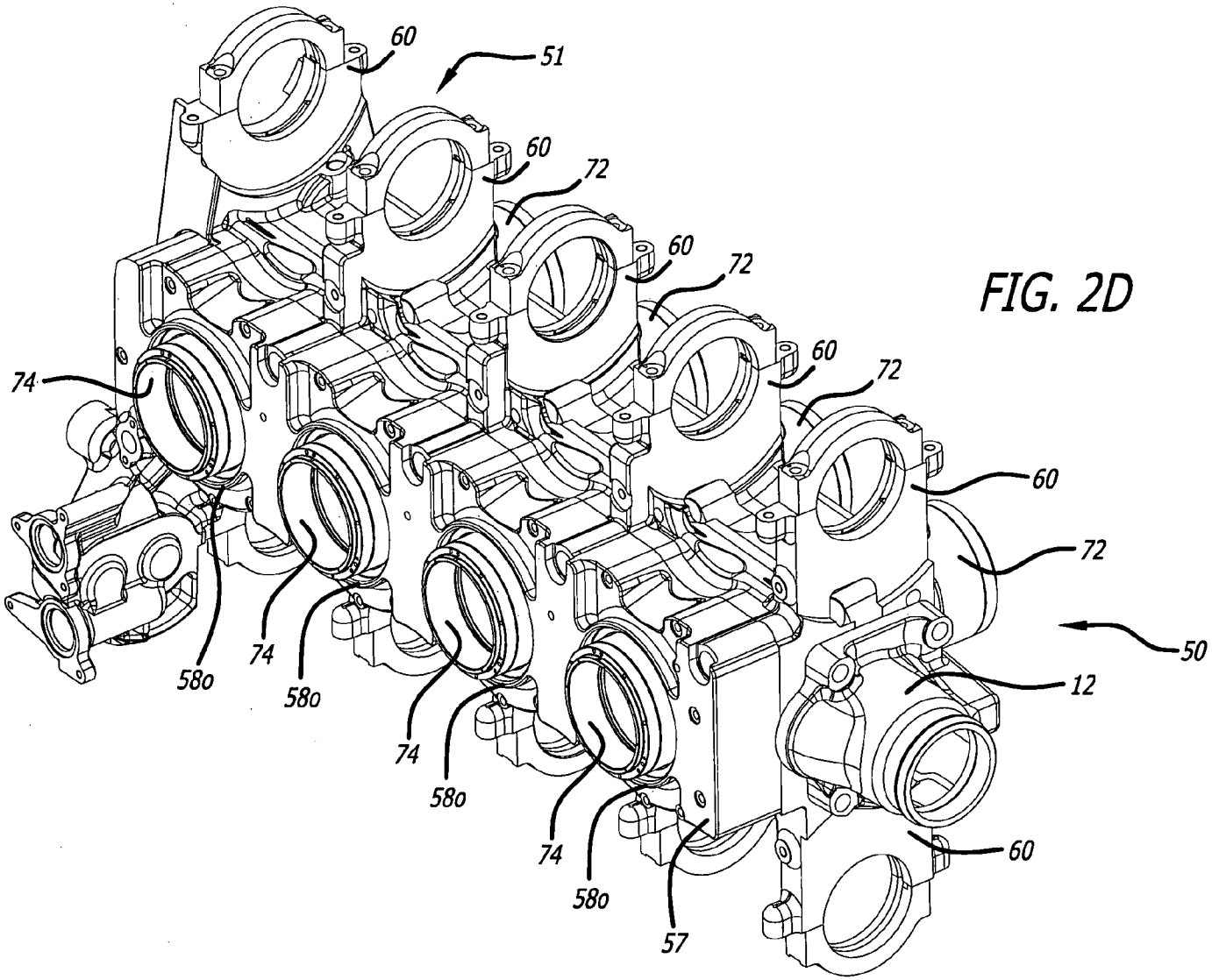
FIG. 2D is a view of the spar from the same perspective as FIG. 2C, with the elements seen in FIGS. 2B and 2C assembled thereto.

As per FIG. 2B, a cylinder liner 70 is supported in each through bore 54. of the spar 50. The cylinder liners 70 are preferably removable from the through bores, although in some constructions, they may be press fit thereinto. Preferably, each cylinder liner 70 is mounted in a respective through bore 54 so as to be sealed therewith against fluid movement along its external surface, yet also so as to be removable therefrom. Each cylinder liner 70 includes an exhaust end 72 with an exhaust port 73 constituted of a circumferential ring of openings, an inlet end 74 with an inlet port 75 also constituted of a circumferential ring of openings, an external circumferential peripheral surface 76, and an internal bore 77 with a longitudinal axis 78. The cylinder liners 70 are disposed in the through bores 54 with the exhaust ends 72 extending out of the through bores along the first side 51 of the spar 50, and with the inlet ends 74 extending out of the through bores 54 along the second side 52 of the spar 50. As best seen in FIG. 2C, an elongate intake cover 57 is attached by threaded screws or bolts to the spar 50, over the inlet plenum 56, to cover and seal the inlet plenum and to form a single plenum chamber wherein air at a positive pressure is provided for all of the cylinder inlet ports 75. The cylinder liners 70 are disposed with the longitudinal axes 78 of their internal bores 77 parallel to each other and lying in a common plane that intersects the inlet plenum chamber. Further, the inlet ports 75 are all positioned within the plenum chamber. A plurality of cones 58 is formed on the inside of the intake cover 57, such that all cones face the inlet plenum 56 when the cover is mounted. Each inlet cone 58 includes an opening **58*o* through the intake cover 57. Each opening 58*o* has a circumferential seal seating groove 58*g*. A seen in FIG. 2D, the inlet end 74 of each cylinder liner 70 extends through the opening 58*o* of a respective inlet cone 58. Each inlet cone 58 includes at least one, and preferably a plurality of vanes 58*v* situated in a circular arrangement in the plenum chamber, around the inlet port 75 of the cylinder liner that extends through the opening 58*o*. The vanes 58*v* of each inlet cone deflect pressurized air from the plenum chamber into the openings of an inlet port 75. Advantageously, this plenum arrangement replaces prior art constructions in which multiple ducts and/or manifolds are attached to the outside of an engine block to feed air to each inlet port individually. Instead, this construction includes a single plenum chamber integrated into the structure of the spar to distribute pressurized air to all of the inlet ports. Further, the vanes 58*v* disposed in the plenum chamber induce swirl into the pressurized air entering the cylinder liners 70 through the inlet ports 75**.

Figure 2E:
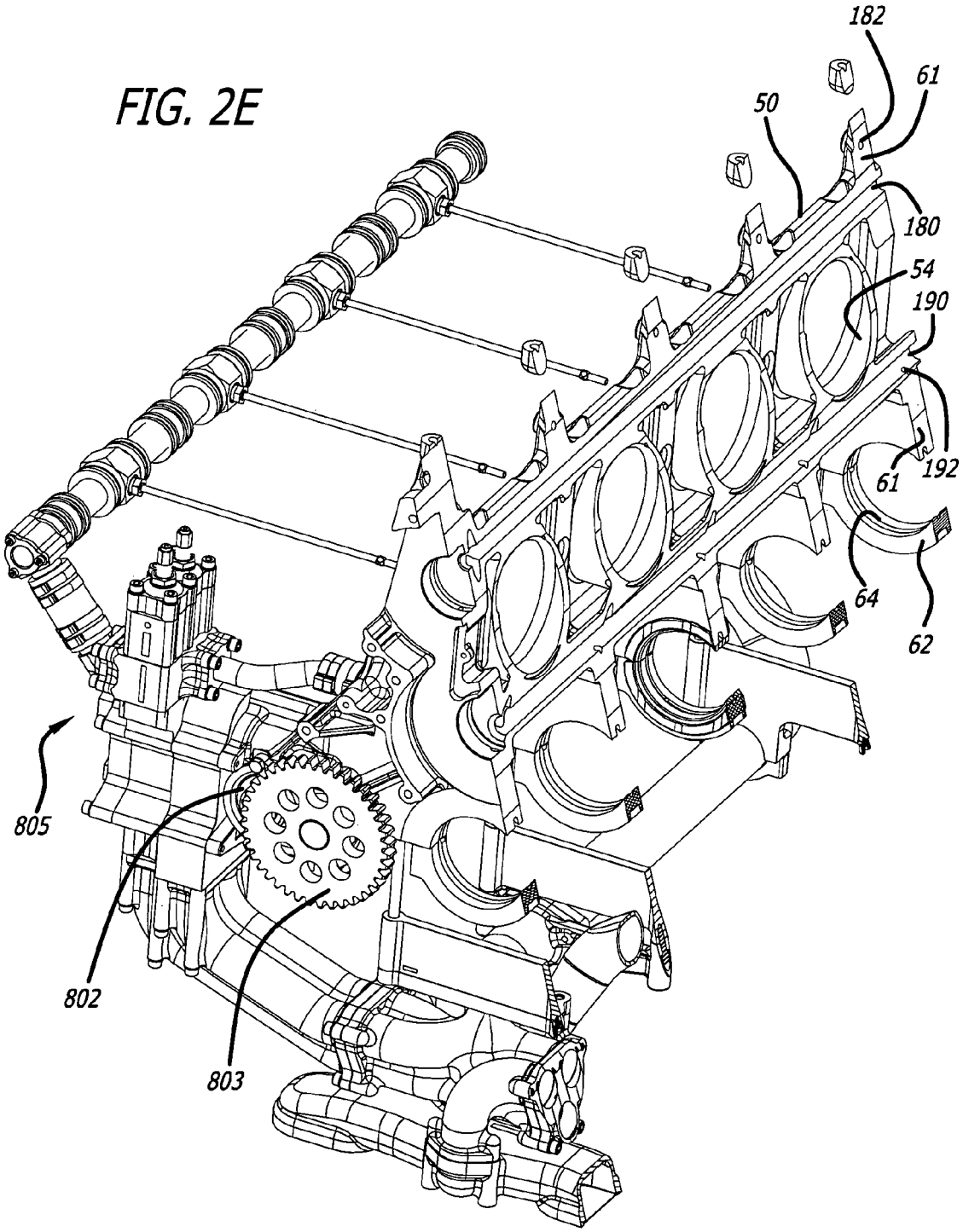
FIG. 2E is a perspective view of a partially rotated cross section of the spar, with elements assembled thereto.

Referring to FIG. 2E, lubricant distribution galleries 180 and 190 extend generally lengthwise in the upper and lower portions of the spar 50, respectively, or opposed sides of the through bores 54. Feed passages extend in the spar 50 from the lubricant distribution gallery 180 to the upper main bearing pedestals 61 along the top of the spar; one such feed passage 182 is seen in FIG. 2G. As seen in FIGS. 2E and 2G, each lubricant feed passage 182 opens into a circumferential lubricant feed groove 64 in the cylindrical inner surface of a respective upper main bearing pedestal 61.

Figure 2F:
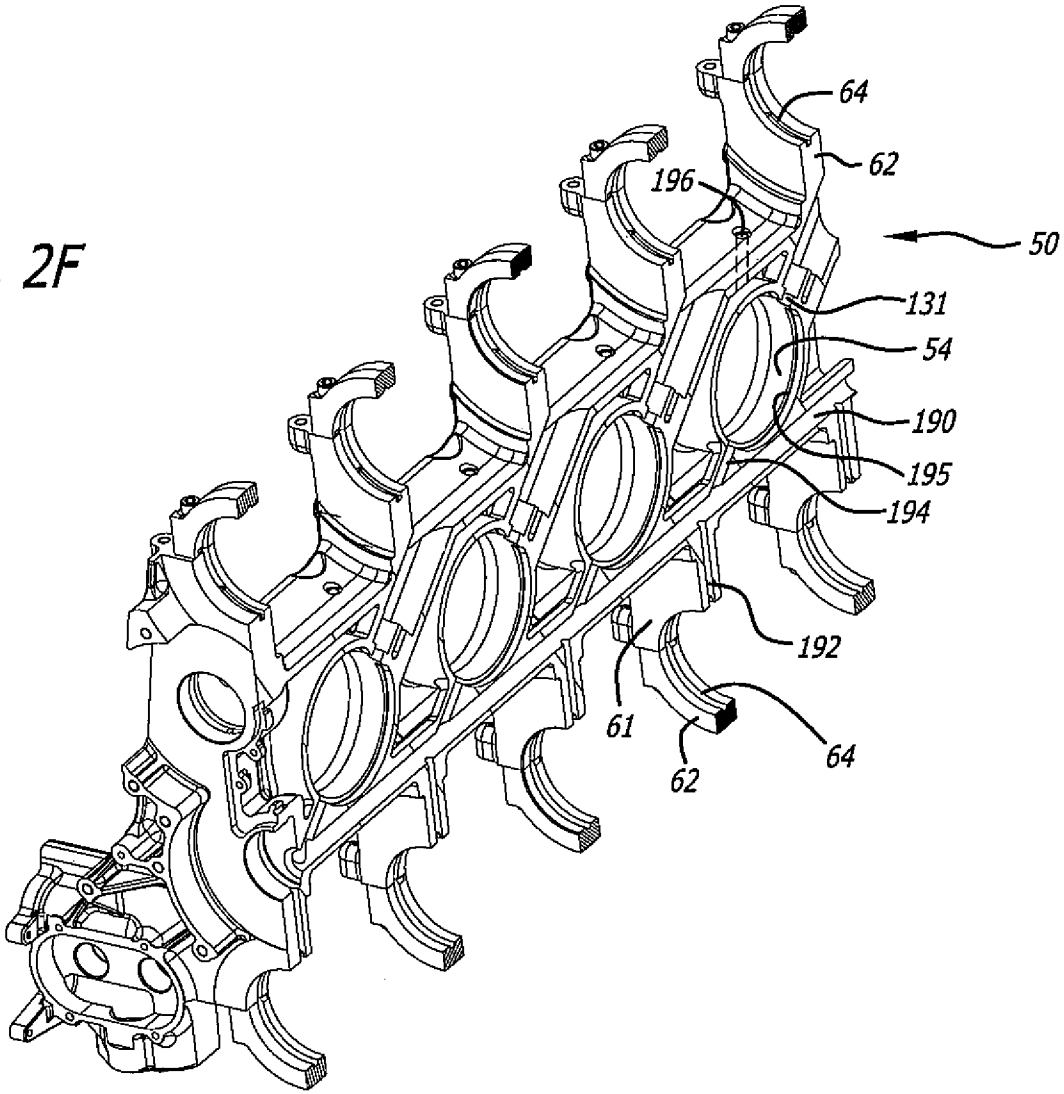
FIG. 2F is a perspective vertical cross section of the spar of FIG. 2A taken along a longitudinal axis of the spar.
Figure 2G:
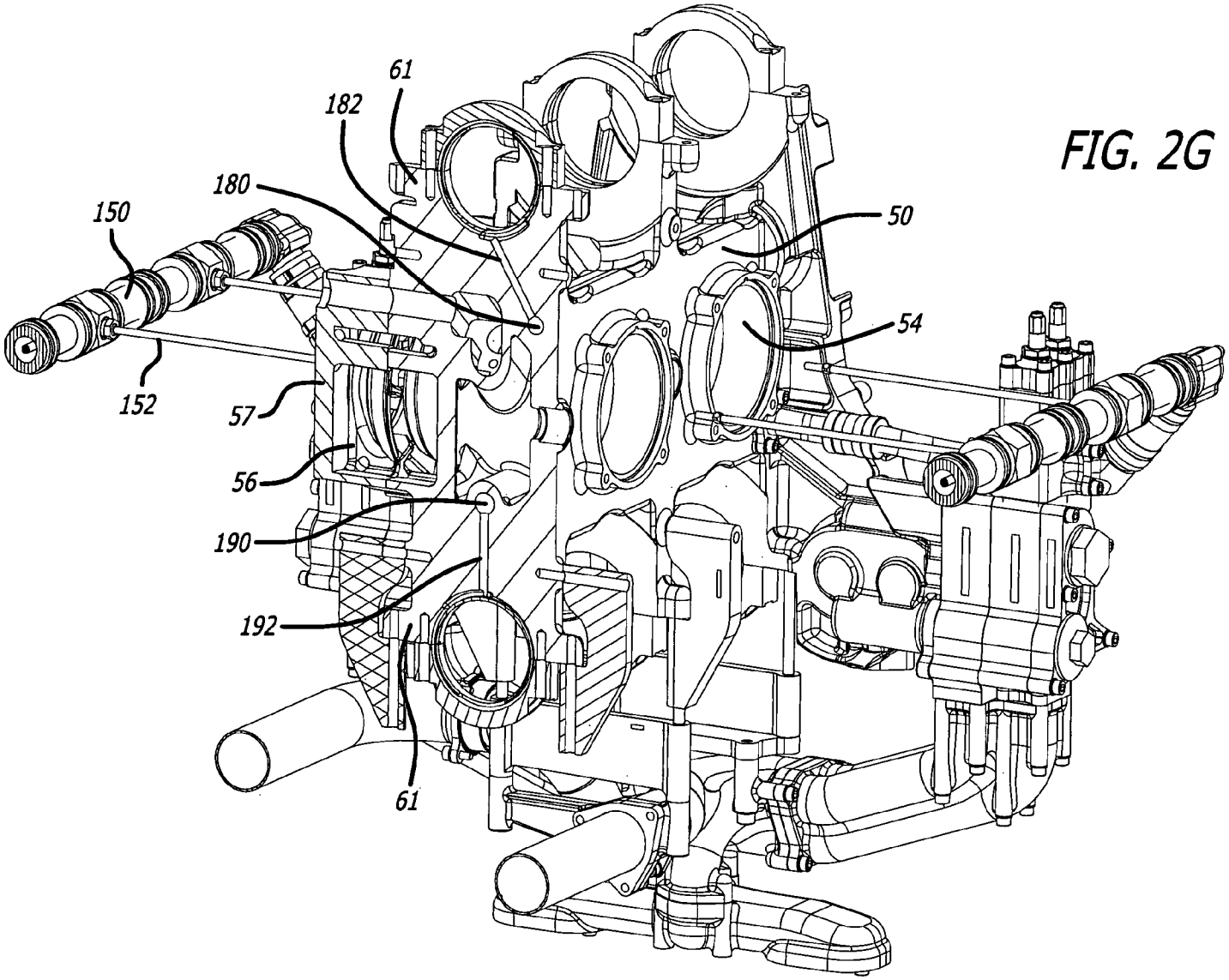
FIG. 2G is a perspective view of a vertical cross section of the spar of FIG. 2A, with certain elements assembled thereto.

Referring to FIGS. 2F and 2G, lubricant feed passages, one indicated by 192, extend downwardly in the spar 50 from the lubricant distribution gallery 190 to the lower main bearing pedestals 61 along the bottom of the engine. Preferably, each lubricant feed passage 192 opens into a circumferential lubricant feed groove 64 in the cylindrical inner surface of a respective lower main bearing pedestal 61. Coolant feed passages 194 extend in the lower portion of the spar 50, upwardly ramped from the lubricant distribution gallery 190 to the through bores 54. Each coolant feed passage 194 opens into a circumferential coolant feed groove 195 on the inside surface of a respective through bore 54 at a location that is diametrically aligned with the axis of a fuel injector bore 131. Upon insertion of the cylinder liners 70 as discussed below, each coolant feed groove 195 forms a coolant passage between the associated through bore 54 and the exterior surface of the cylinder liner 70. As per FIG. 3D, a coolant drain passage 196 extends in the upper portion of the spar 50 upwardly from each through bore 54. Preferably, each through bore 54 is served by at least one, and preferably two, such drain passages. As per FIGS. 3C and 3D, each drain passage 196 opens at one end into respective circumferential collector groove of a through bore 54, and at the other end (as seen in FIG. 2F) through the top of the spar 50, preferably through the upper surface of the spar, where the upper main bearing assemblies 60 are mounted.

Figure 3A:
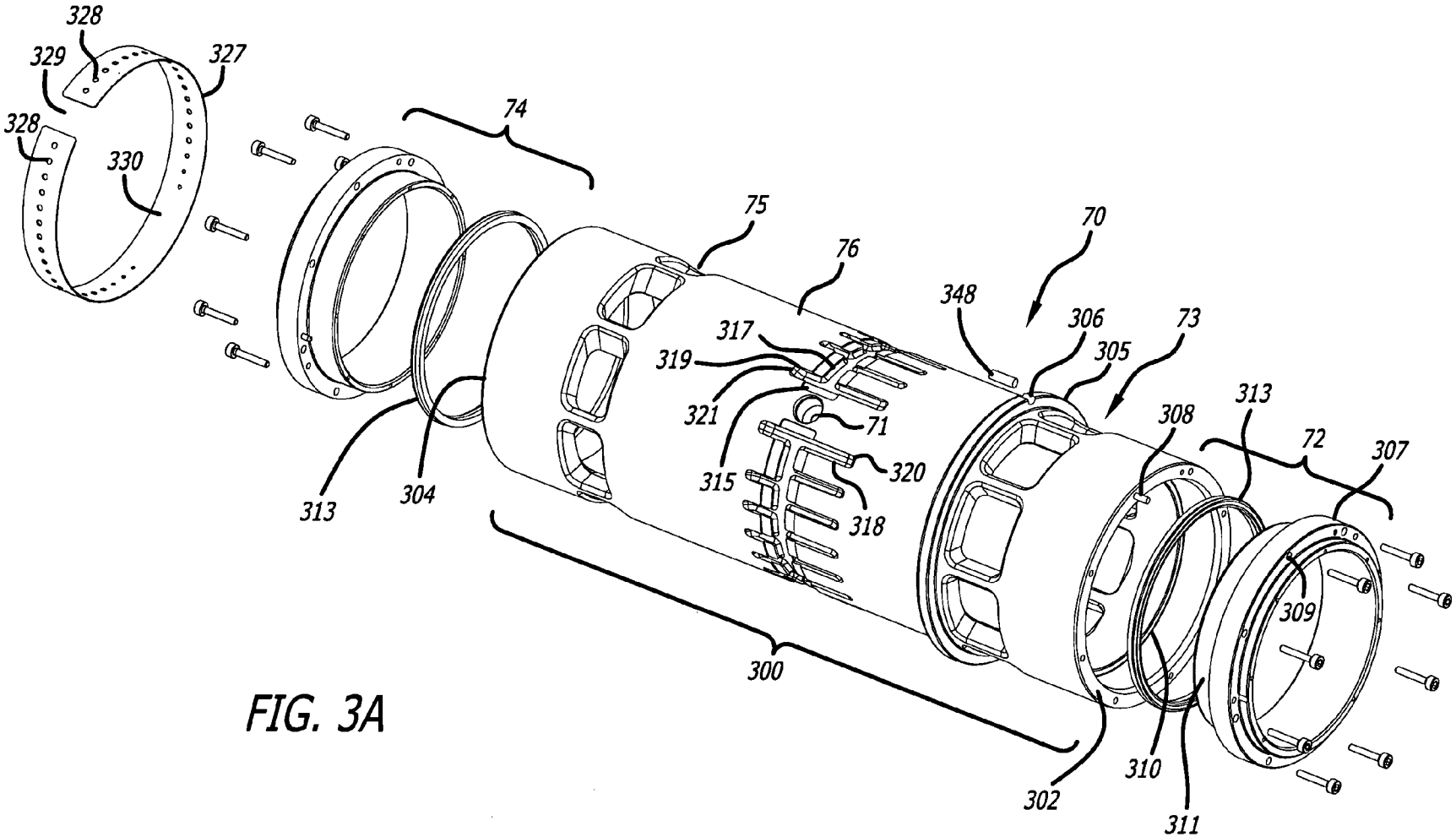
FIG. 3A is an exploded perspective view of a cylinder liner which may be assembled to the spar of FIG. 2A.
Figure 3B:
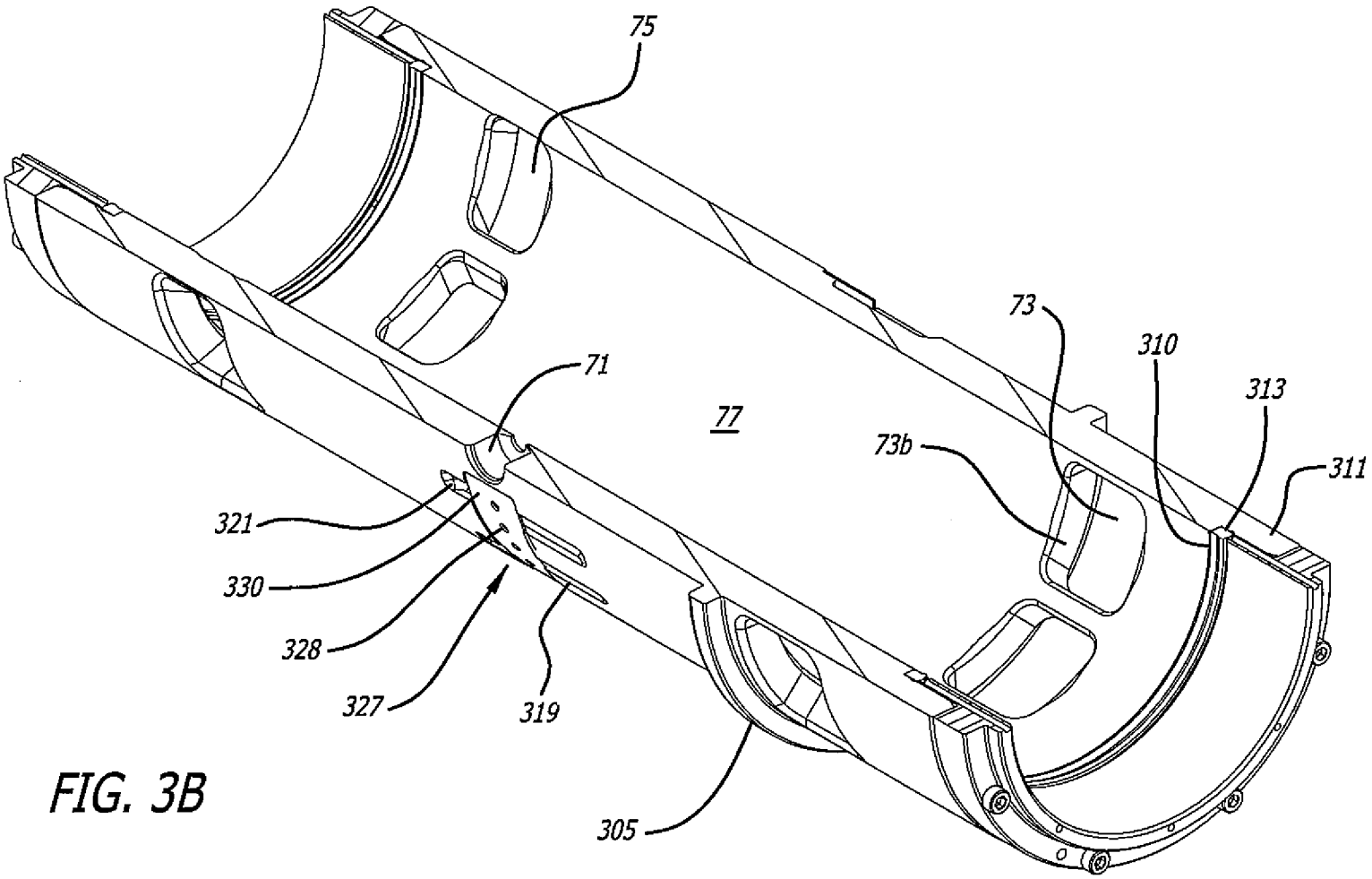
FIG. 3B is a side sectional view of the cylinder liner of FIG. 3A.

All of the cylinder liners 70 may be constructed and assembled as shown in FIGS. 3A and 3B, where the cylinder liner 70 includes a liner tube 300 with the exhaust and inlet ports 73, 75 formed near its end rims 302, 304. A circumferential flange 305 is formed on the external surface of the liner tube, abutting the inside edge of the exhaust port 73 such that the exhaust port 73 is located between the flange 305 and the exhaust end 72. An alignment notch 306 is provided in the flange 305. The exhaust end 72 is constituted of an end cap 307 that is aligned with the rim 304 by pin 308/hole 309 and is attached to the rim 304 by threaded screws or bolts. At the exhaust end 72, the internal bore of the liner tube 300 has an increased internal diameter, forming a raised shoulder 310 displaced longitudinally into the liner from the exhaust end 72. The outer diameter of the end cap 307 is reduced around its inner end 311, and the rim of the inner end 311 is received through the rim 302 of the liner tube. When the end cap 307 is attached to the rim 302, the inner end 311 is positioned just short of the raised shoulder 310, forming an annular wiper groove 312 (FIG. 3B) wherein an annular wiper 313 is received and retained. With reference to FIG. 3B, the groove 312 and wiper 313 are located in the internal bore 77, between the exhaust end 72 and exhaust port 73 of the liner. The displacement between the groove 312 and the port 73 defines an annular area where compression rings (described below), mounted to the crown of the piston, are located when the piston is at BDC during engine operation. In some aspects of the constructions described herein, longitudinal oil discharge grooves 314 may be formed on the inside surface of the end cap's bore. If provided, the grooves preferably extend from the oil discharge groove 314 to the outside rim of the end cap 307. The inlet end 74 may be similarly constructed, and an annular wiper groove 312 and wiper 313 are located in the internal bore of the cylinder liner 70, between the inlet port and the inlet end of the liner 70. In some aspects, the discharge grooves can be replaced with discharge passages bored through the end cap to the wiper groove 312. In alternative embodiments, the end cap bore may have no discharge grooves or discharge passages, as seen in FIG. 3E.

As best seen in FIG. 3A, a shallow, preferably flat, circumferential trench 315 is formed in the central portion of the external surface 76 of the cylinder liner 70. The circumferential trench 315 is interrupted or split to provide a support area through which the injection port 71 is bored. A narrow circumferential central groove 317 is formed generally in the center of the trench 315. Longitudinal grooves 318, 319, extending from the central groove 317 toward the ends 72 and 74, are formed in the external surface 76. The grooves 318 extending toward the exhaust end 72 are of uniform length so that their ends 320 align circumferentially on the external surface 76. The grooves 319 extending toward the inlet end 74 are of uniform length so that their ends 321 align circumferentially on the external surface 76. Per FIG. 3A, the length of the grooves 318 may be greater than the length of the grooves 319 in order to provide asymmetrical cooling of the cylinder liner as described in the referenced publication US2007/0245892, wherein greater cooling capacity is afforded to the exhaust side of the cylinder liner 70 than to the inlet side. As seen in FIG. 3B, a split collar or flattened ring 327 fits into, and covers, the trench 315 and groove 317, but leaves the longitudinal grooves 318 and 319 uncovered. A sequence of holes 328 runs along each half circumference of the collar 327, from a respective edge of the split to with a non-apertured portion 330 opposite the split 329 in the ring. Around each half circumference, the diameters of the holes 328 increase incrementally from the portion 330 to the split 329.

Figure 3C:
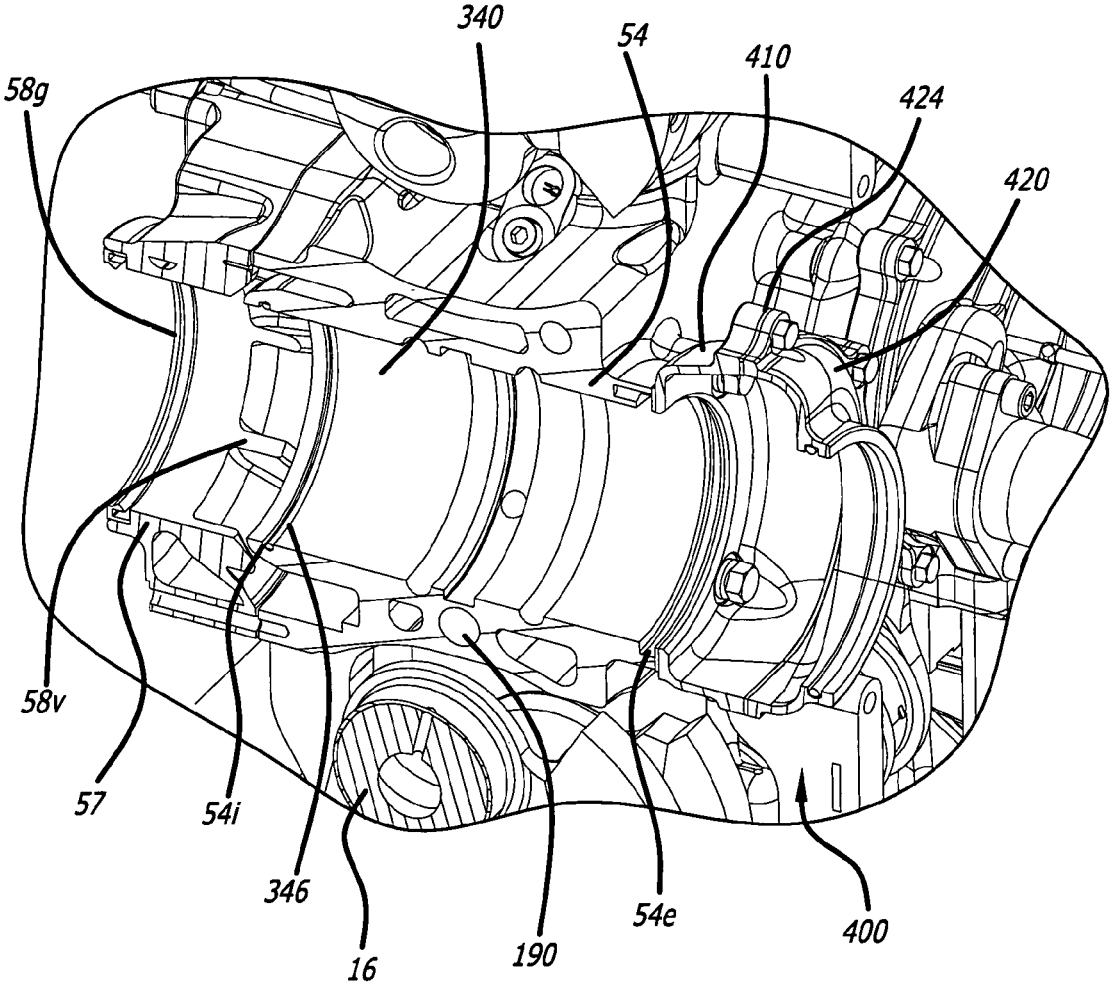
FIG. 3C is a side sectional view of a through bore of the spar of FIG. 2A which receives a cylinder liner such as the cylinder liner of FIG. 3A.
Figure 3D:
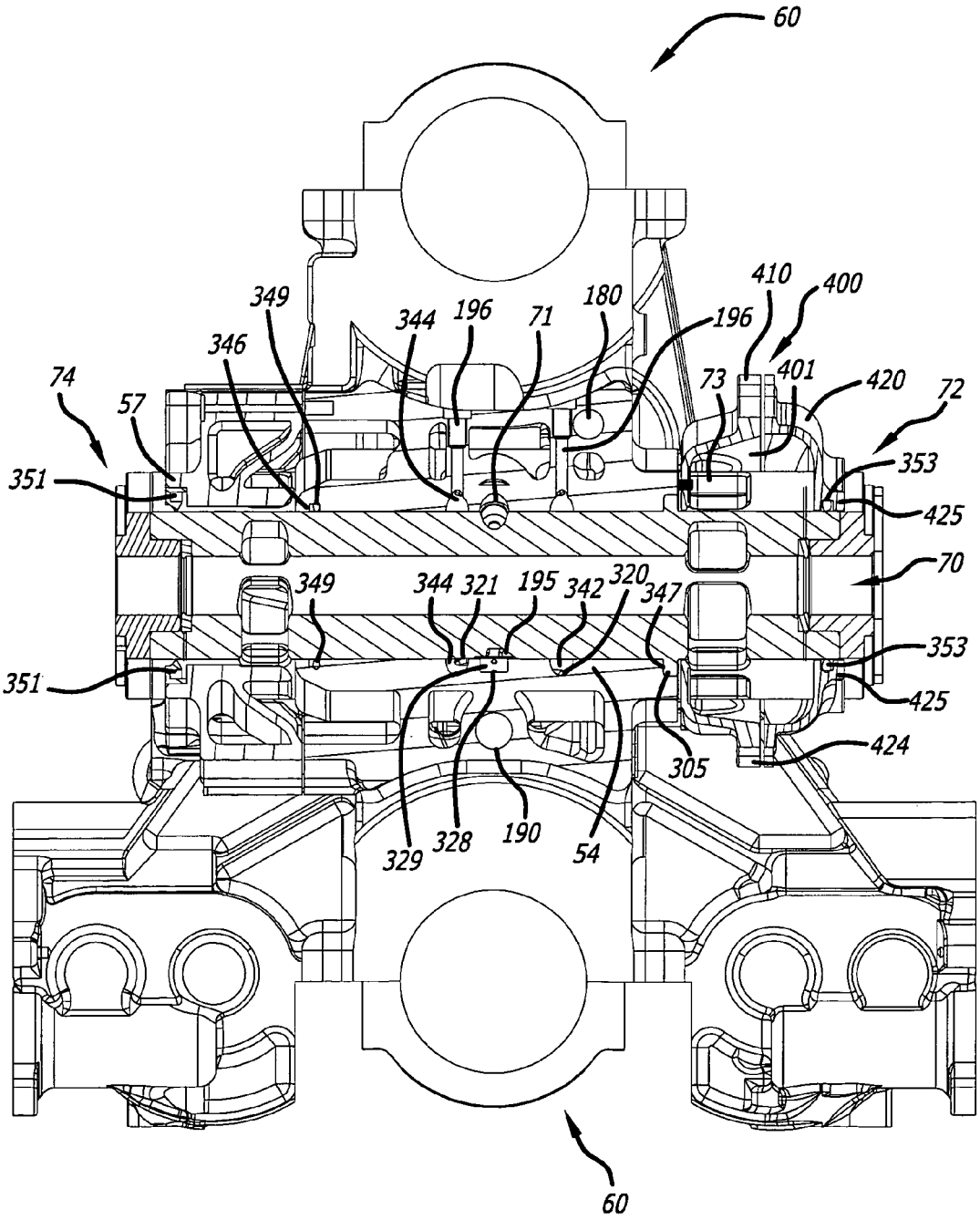
FIG. 3D is a frontal vertical cross sectional view of the spar of FIG. 2A with the elements of FIGS. 2B and 2C assembled thereto.
Figure 3E:
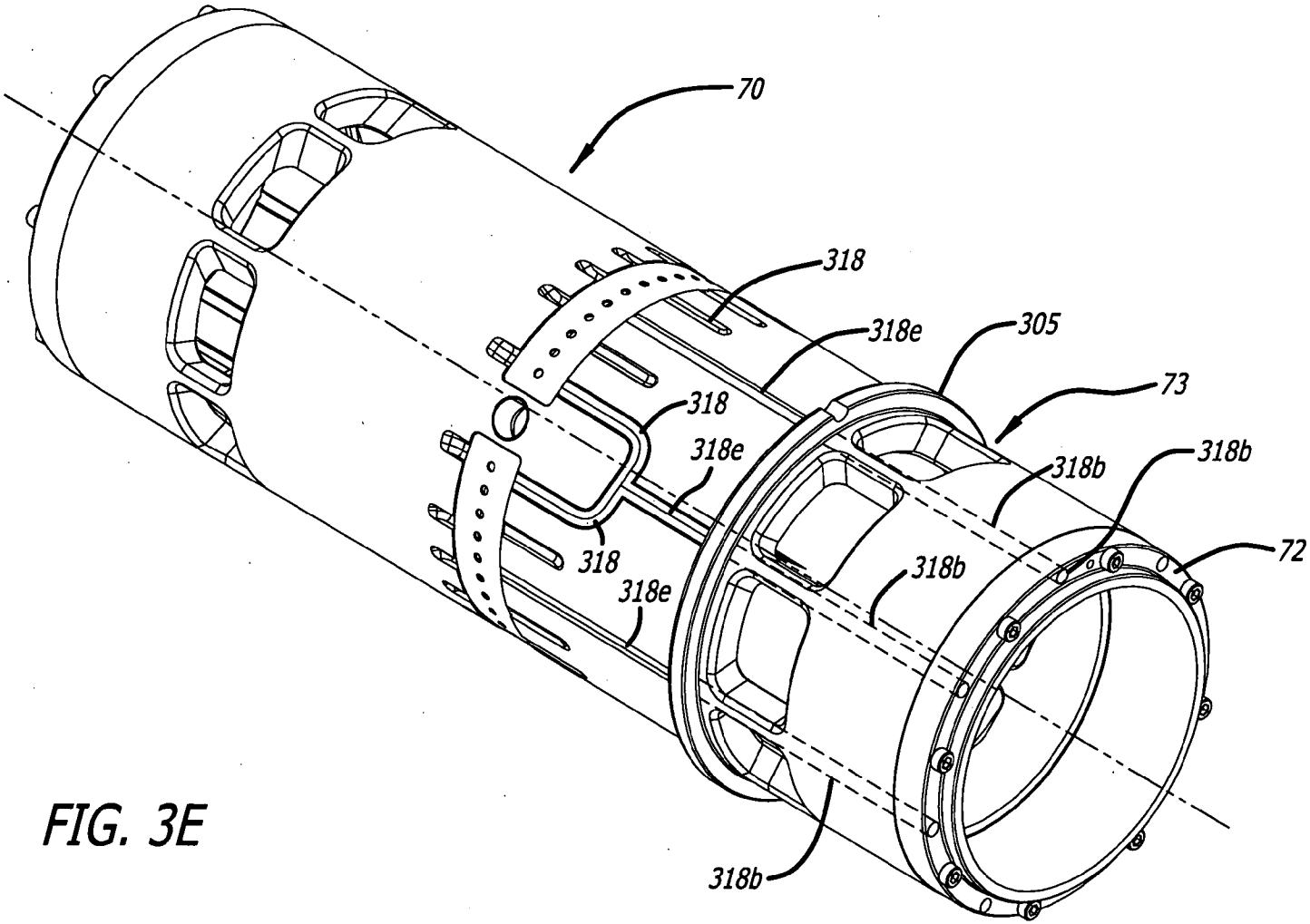
FIG. 3E is a perspective view of the cylinder liner of FIG. 3A, with an alternate

Per FIG. 3E, the asymmetrical cooling configuration of the cylinder liner 70 may include bores drilled longitudinally in the cylinder liner, as is taught in the reference publication US2007/0245892. In this regard, grooves 318*a* of the plurality of longitudinal grooves 318 that align with bridges 73*b* of the exhaust port 73 and that are longer than the other grooves 318. The grooves 318*e* may extend toward, if not up to, the flange 305. The end of each groove 318*e* is in fluid communication with a longitudinal passage 318*b* bored through an exhaust port bridge 73*b* and to the exhaust end 72 of the cylinder liner 70. In addition, the ends 320 of the grooves 318 on either side of the injection port 71 may be brought together into a common groove in fluid communication with a longitudinal passage 318*b*. Each of the bored longitudinal passages 318*b* opens to a hole 318*h* in an end cap 307. Fluid communication between an elongated groove 318*e* and an associated longitudinal bore 318*b* may be provided by a bore drilled radially to the cylinder liner between the end of the groove 318*e* and the bore 318*b*. This configuration permits coolant to flow through the elongated grooves 318*e* and the exhaust port bridges 73*b*, and then out of the exhaust end 72 of the cylinder liner.

All of the through bores 54 in the spar 50 may have the construction shown in FIG. 3C. The through bore 54 has exhaust and inlet ends 54*e* and 54*i*, an inner bore surface 340 with coolant collector grooves 342 and 344, a coolant feed groove 195 between the collector grooves, a seating groove 346 in the inlet end 54, and a seating groove 347 in the exhaust end 54*e*. With reference to FIGS. 3C and 3D, when a cylinder liner 70 is assembled to the through bore 54, an annular seal 349, such as an elastomeric O-ring, is seated in the groove 346 in the bore surface 340. Then the cylinder liner 70 is inserted through the exhaust end 54*e* of the through bore 54, inlet end 74 first, with the notch 306 (FIG. 3A) aligned with a through bore pin 348 in order to orient the injection port 71 of the cylinder liner 70 with an injector bore (not seen) in the spar 50. With the cylinder liner 70 thus oriented, it is pushed home until the flange 305 contacts and is seated against the edge of the seating groove 347. As per FIG. 3D, with the cylinder liner 70 oriented and seated in the through bore 54, the coolant collector groove 342 is aligned with the ends 320 of the longitudinal grooves 318, the coolant feed groove 195 is aligned with the holes 328 in the collar 327, the coolant collector groove 344 is aligned with the ends 321 of the longitudinal grooves 319, and the injection port 71 is aligned with an injector bore. The cylinder liner 70 is secured in place on the spar 50 at its inlet end 74 by the intake cover 57 and, at its exhaust end 72 by an exhaust collector 400 secured to the exhaust end 54*e* of the through bore 54. An annular seal 351, such as an elastomeric O-ring, is seated in the groove 58*g* in the cone opening 58*o* of the intake cover. An annular seal 353, such as an elastomeric O-ring, is seated in a groove of exhaust collector 400.

As per FIG. 3D, with the cylinder liner 70 oriented and seated in the through bore 54, the seal 349 seats against the external surface of the cylinder liner 70, between the ends 321 and the inlet port 75, forming a fluid seal that blocks leakage of liquid along the external surface from the ends 321 into the inlet plenum chamber and the inlet port 75. The seal 351 seats against the external surface of the cylinder liner 70, between the inlet end 74 and the inlet port 75, forming a fluid seal that blocks the leakage of fluid in either direction. That is to say, the seal 351 blocks the passage of liquid lubricant along the external surface of liner 70 from the inlet end 74 into the plenum chamber and inlet port 75. The seal 351 also blocks the leakage of air into and out of the inlet plenum chamber. The seal 353 seats against the external surface of the cylinder liner 70, between the exhaust port 73 and the exhaust end 72, forming a fluid seal that blocks the leakage of fluid in either direction. That is to say, the seal 353 blocks the passage of liquid lubricant along the external surface of the cylinder liner 70 from the exhaust end 72 into the exhaust collector 400 and exhaust port 75. The seal 353 also blocks the leakage of air into and exhaust gasses out of the exhaust collector 400. The flange 305 blocks the leakage of liquid along the external surface from the ends 320 into the exhaust collector 400 and the exhaust port 73.

Thus, while a cylinder liner 70 is supported in a through bore 54, it is stabilized and secured against movement in the spar 50 by retaining the liner's flange in the seating groove at the exhaust end of a through bore when an exhaust collector 400 is secured thereto. No part of the cylinder liner is formed integrally with any other component of the engine. Each cylinder liner is therefore isolated from the introduction of thermal and mechanical distortions from those quarters. In the preferred embodiment, the cylinder liner 70 can be removed from the engine, which facilitates repair and maintenance. Further, when seated in a through bore, the cylinder liner 70 is sealed against passage of fluid between its external surface and the through bore in which it is seated. During engine operation, the cylinder liner 70 is seated, secured, and sealed more firmly in the through bore 54 when it expands in response to the heat of combustion. Of course, while it is preferred that the cylinder liners 70 be removable from the through bores 54, there may be instances where the cylinder liners would be press fit into the through bores so as to be permanently seated therein.

Figure 4:
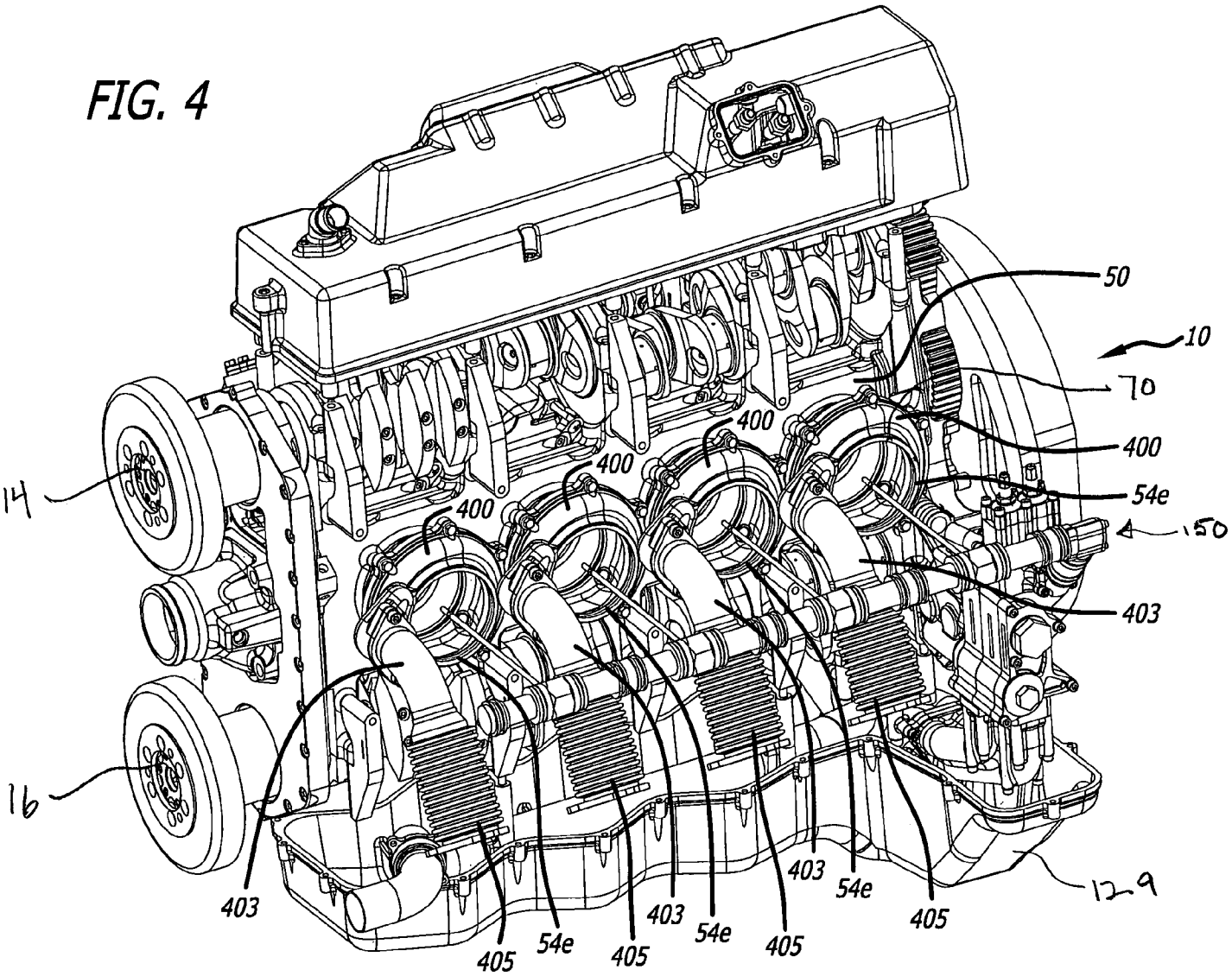
FIG. 4 is a perspective view of the engine of FIG. 1A, with covers removed from one side thereof.

As seen in FIG. 4, an arrangement of exhaust collectors 400 extends lengthwise on the spar 50 along the first side. Each exhaust collector 400 is mounted to the exhaust end **54*e* of a through bore 54. As seen in FIGS. 3C and 3D, an exhaust collector is in fluid communication with the exhaust port 73 of a respective cylinder liner 70. All of the exhaust collectors may be constructed and assembled as shown in FIGS. 2B and 3D, where the exhaust collector 400 forms a generally toroidal chamber 401 that surrounds the exhaust port 73 of a cylinder liner 70. As best seen in FIG. 4, each exhaust collector 400 includes a duct 403. Each duct 403 is offset from the vertical midline of the exhaust end 72 of the cylinder liner 70 to which it is mounted, which is reserved for reciprocal movement of connecting rods. Each duct transitions to an exhaust pipe 405 leading through the engine casing to an exhaust manifold (not seen). Per FIG. 3D, a toroidal potion of each exhaust collector 400 includes an inner collector 410 and an outer collector 420. The inner and outer collectors have the general shape of a torus cut in half around its outside perimeter with flattened front and rear surfaces. As best seen in FIG. 3C, the inner collector 410 is secured to the exhaust end 54*e* of the through bore 54 by way of threaded screws or bolts received in threaded bores (seen in FIG. 2B), which are spaced around the exhaust end 54*e*. As per FIG. 3C, the inner and outer collectors 410 and 420 are joined at a flange 424 with threaded openings through which screws or bolts are received to secure the two parts together. As per FIG. 3D, the inner edge of the inner collector's rear surface abuts the outer edge of the flange 305. The outer collector 420 includes an annular groove 425 in its inner bore facing the exhaust end of the cylinder liner, in which the annular seal 353** is seated.

Figure 5A:
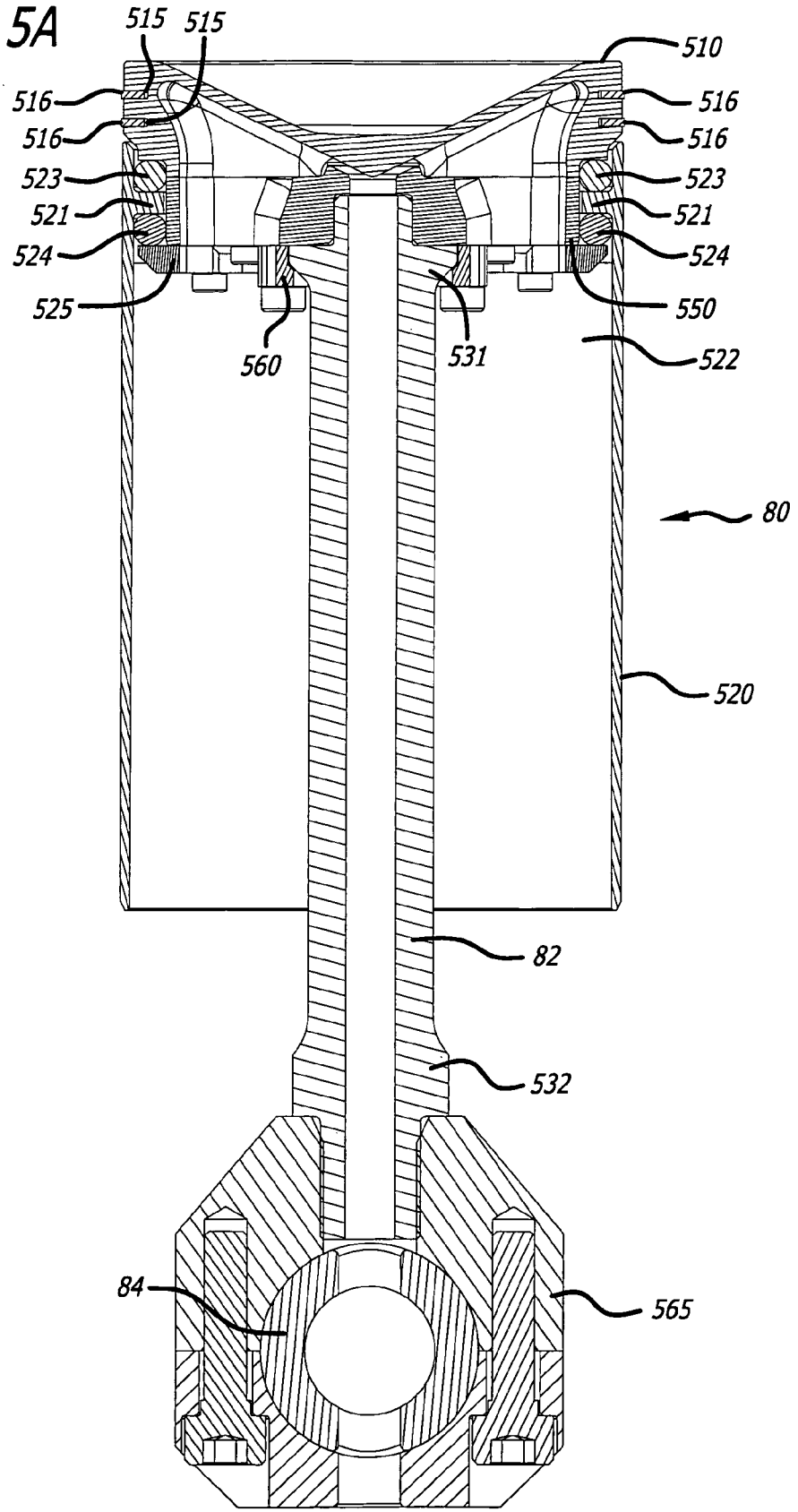
FIG. 5A is a side sectional view of a piston with a moveable skirt which may be received in the cylinder liner of FIG. 3A.
Figure 5B:
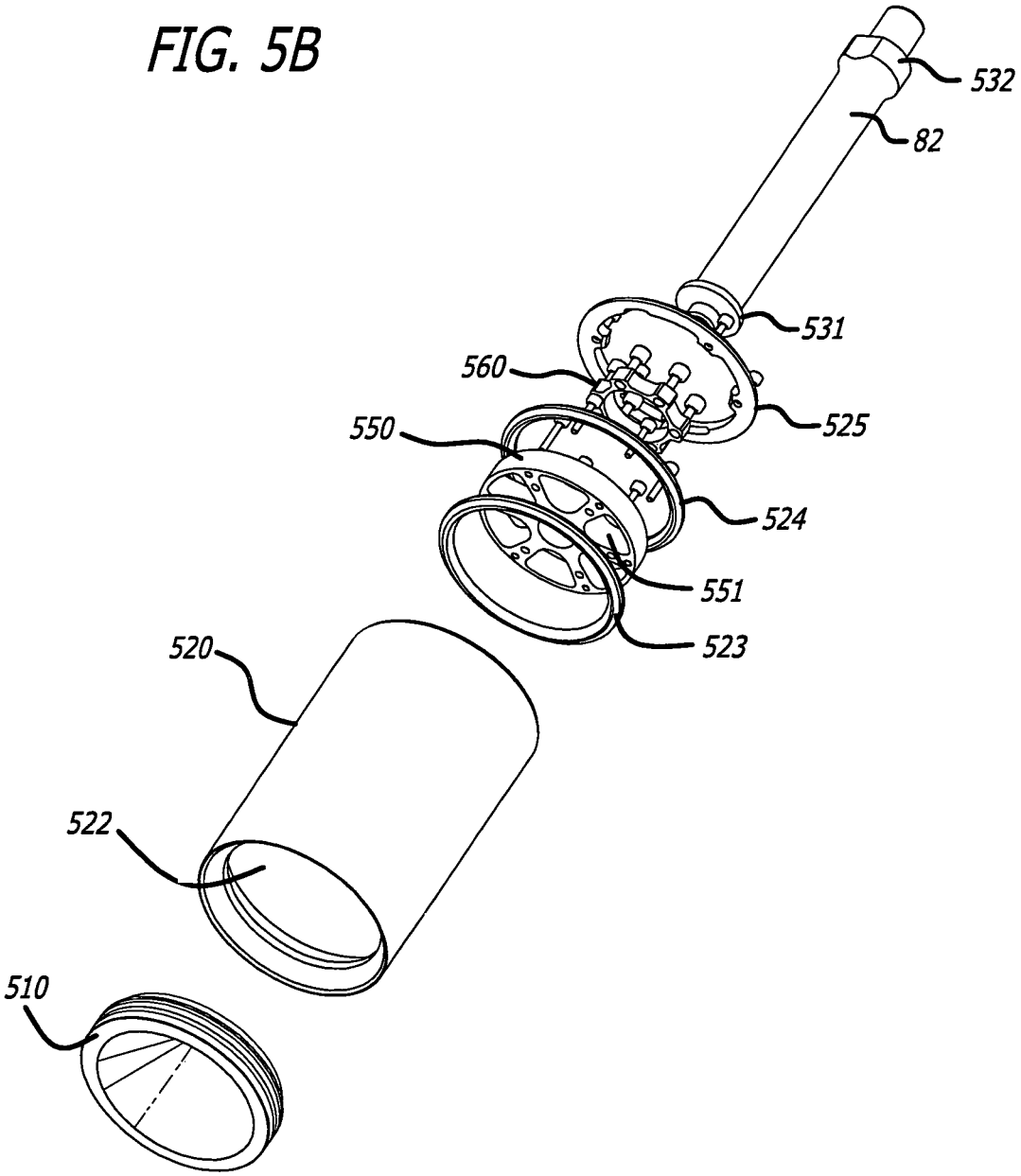
FIG. 5B is a perspective exploded view of the piston of FIG. 5A showing elements of the piston.

All of the pistons 80 may be constructed and assembled as shown in FIGS. 5A and 5B, where the piston 80 includes a crown 510, a skirt 520, and the piston rod 82, which has a tubular construction. The piston is assembled to a pin 84. As per FIG. 5C, the rear of the crown 510 is formed with wedge-shaped radial walls 511 with inner and outer rings of threaded bores. The thin ends of the radial walls converge on a central dome 512 that slopes toward wedge-shaped notches 513 between the walls. The skirt 520 has a tubular shape with a flange 521 formed on the inner surface 522 of the skirt, near the end of the skirt that joins the crown 510. As per FIG. 5A, the crown 510 is received on and closes the one end of the skirt 520. A flexible ring 523 (such as an O-ring) grips a lower inset rim of the back of the crown 510 and is held between a circumferential ridge formed in the back of the crown and one side of the flange 521. Another flexible ring 524 (such as an O-ring) is held between the other side of the flange and the outer edge of a retaining ring 525 that is mounted to the back of the crown. The flexible rings and the flange form an annular, resiliently deformable joint coupling the crown 510 and skirt 520 that permits the skirt 520 to swing slightly on the crown 510 with respect to the piston rod 82, within a truncated cone centered on the axis of the rod and widening from the flange 521 toward the open end of the piston skirt.

As per FIGS. 5A and 5B, the piston rod 82 includes flanges 531 and 532 on its external surface. The flange 531 is set back from one end of the rod, and the flange 532 is set back from a threaded end of the rod, and has a smaller diameter than that of the flange 531. The construction of the piston 80 further includes an insert 550 attached to the back of the crown 510 by threaded screws or bolts received in the inner ring of threaded bores, with wedge-shaped notches 551 aligned with the corresponding notches in the crown 510. As per FIG. 5C, the flexible ring 524 grips the outer perimeter of the insert 550. The piston rod 82 is secured to the insert 550 with one end of the piston rod 82 centered in the central opening 552 of the insert and the circumferential flange 531 sandwiched between the insert 550 and a rod retainer 560 passed over the flange 532. Threaded screws or bolts secure the retainer 560 to the insert 550. The retaining ring 525 mounts on the back of the insert 550, around the insert, and is secured to the crown 510 by threaded screws or bolts that extend through the insert and are received in the outer ring of threaded bores in the back of the crown 510. With reference to the side sectional views of FIGS. 5A and 5C, the wedge-shaped spaces in the back of the crown 510 and the insert 550 are mutually aligned and are centered on, and radially symmetrical with respect to, the tubular piston rod 82. Further, as seen in FIG. 5A, the outer end of the piston rod 82 is press fit to the lower half of a split collar 565 attached to a pin 84. As further described in U.S. Pat. No. 7,360,511, a piston coolant jet 152 extends through the pin 84 into the bore of the tubular piston rod 82. During engine operation, the pin 84 slides back and forth along the piston coolant jet, which is fixed to a piston coolant manifold.

Figure 5C:
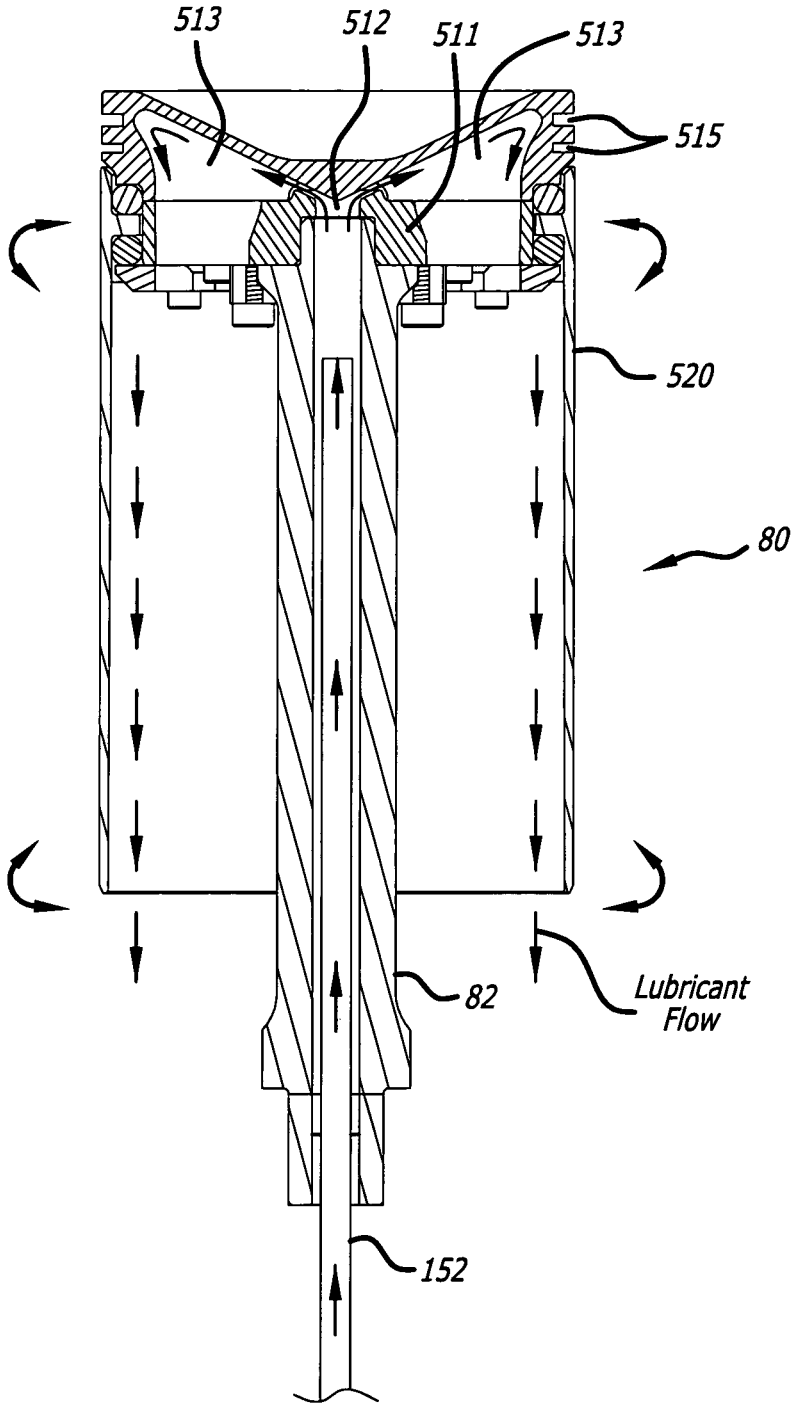
FIG. 5C is a side sectional view of the piston of FIG. 5A rotated by 90° from its position in FIG. 5A.
Figure 5D:
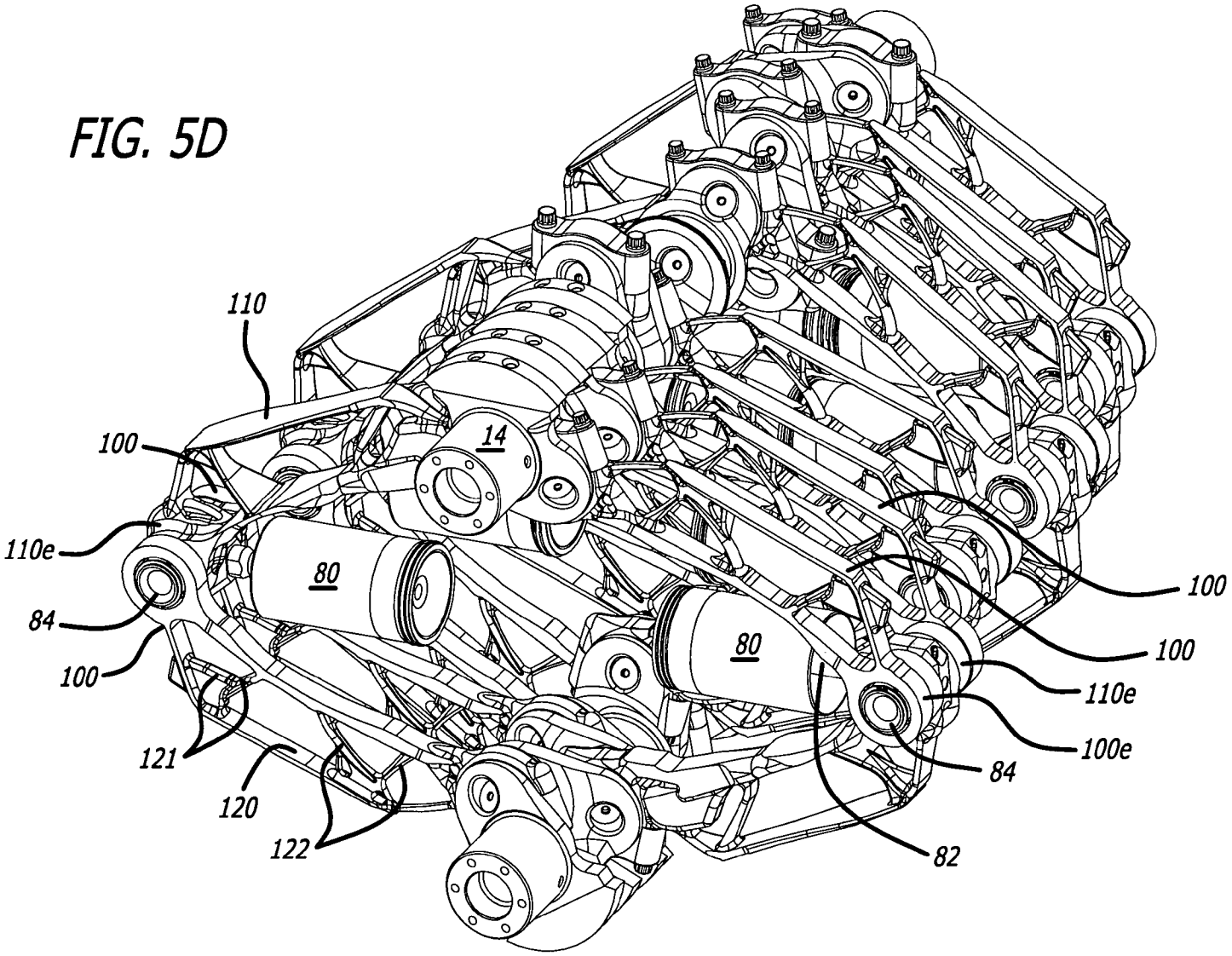
FIG. 5D is a perspective view showing each of a plurality of pistons according to FIG. 5A coupled by connecting rods to two crankshafts seen in FIG. 1B.

As best seen in FIG. 5D, each connecting rod 100 and 110 is a bent beam having an elongate open work configuration framed by an outside perimeter frame 120. At least one strut 121, extending between the opposing long sides of the perimeter frame, is provided near the end of each connecting rod that is coupled to the pin 84, and at least one other strut 122 extending between the opposing long sides of the perimeter frame is provided near the end that is coupled to a crankshaft. In the manner described in referenced U.S. Pat. No. 7,360,511, three connecting rods that swing on the pin 84 couple each piston 80 to both crankshafts 14 and 16. In this regard, a single, connecting rod 110 with a split end **110*e* received on the pin 84, around the split collar 565, links the piston to one crankshaft, and two connecting rods 100 with single ends 100***e* received on the pin 84 on respective outer sides of the split end 110*e* link the piston to the other crankshaft.

With reference to FIG. 5A, one or more circumferential grooves 515 may be formed in the upper portion of the perimeter of the crown 510. For example, two grooves may be formed therein with one or more split, annular, compression rings 516 mounted therein. Preferably, one steel compression ring is mounted in each of the two grooves, with their gaps offset by, for example, 180°. The compression rings are provided to seal the narrow annular space between the crown 510 and the bore of a cylinder against the passage of combustion gasses (also referred to as "blowby") during engine operation. Preferably, the compression rings 516 are conventional steel rings with nominal diameters greater than that of the inner bore of the cylinder liner such that the seals are loaded against the bore of the cylinder liner.

Figure 6:
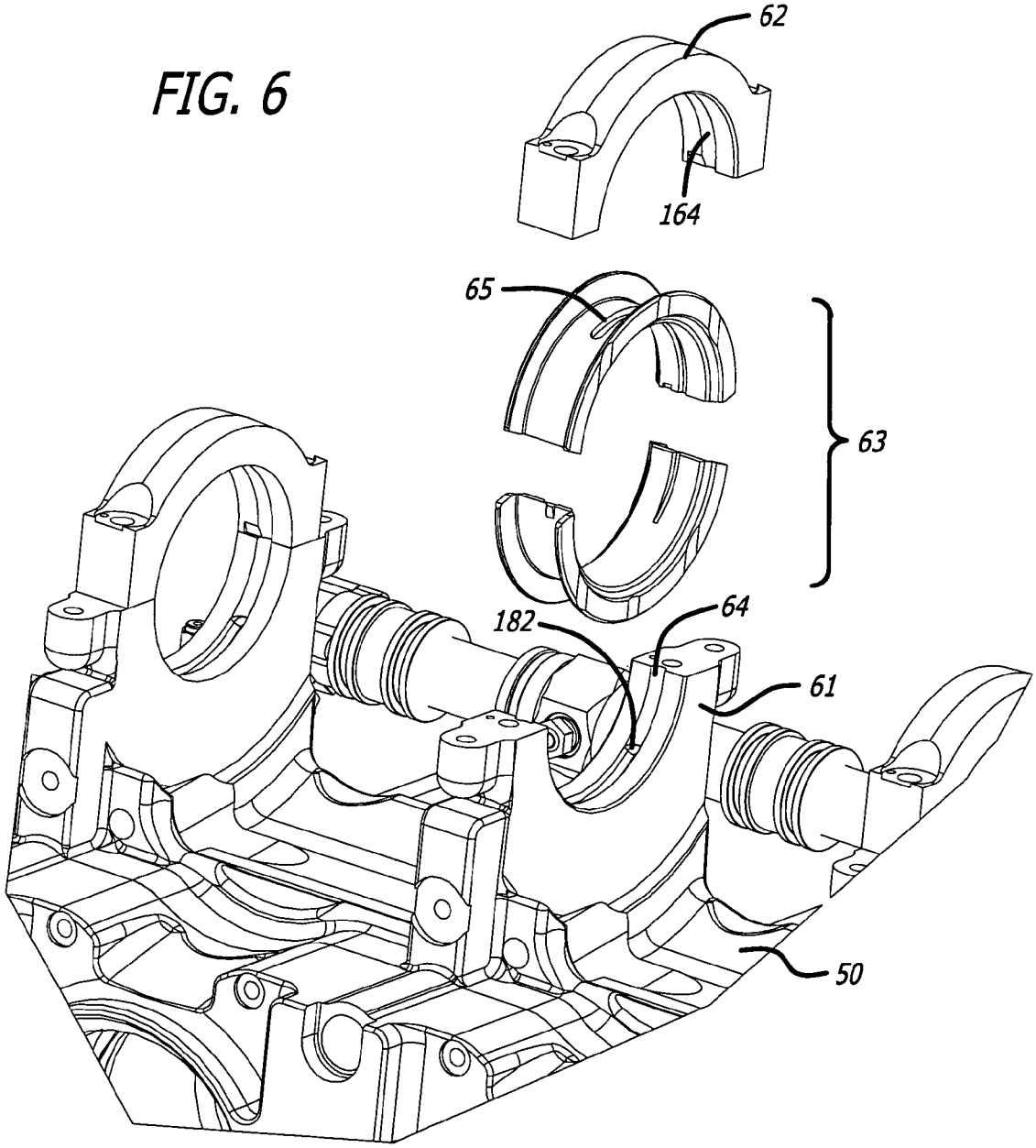
FIG. 6 is an exploded view of a main bearing assembly of the engine of FIG. 1A.

Each of the main bearings 60 may be constructed and assembled as shown in FIG. 6, where the main bearing 60 includes a pedestal 61, an outer piece 62, and a tubular bearing sleeve 63. When the outer piece 62 is secured to the pedestal 61, a circumferential lubricant feed groove 64 is defined in the cylindrical inner surface formed by the main bearing pedestal 61 and the outer piece 62. A lubricant feed passage 192 extends through the spar 50 from the lubricant distribution gallery 190 to the portion of the lubricant feed groove 64 in the main bearing pedestal. An opening 65 in the bearing sleeve 63 is positioned over the groove 64, opposite the upper surface of the spar 50, when the sleeve 63 is received and held between the pedestal 61 and the outer piece 62. Each main bearing 60 rotatably supports a main journal of a crankshaft. Although not seen, drilled lubricant feed passages in each crankshaft extend between main journals and adjacent crank journals, and each crank journal, includes one or more bores from which lubricant flows to hydro-dynamically lubricated journal rod bearings by which connecting rods are coupled to the journal. Thus, during engine operation, lubricant flows into the main bearings 60, and through the openings 65 to lubricate the bearing interface between the main bearing sleeves 63 and the main journals of the crankshafts 14, 16. As the crankshafts rotate, lubricant is also injected from the bearing sleeve openings 65 into the drilled feed passages in the main bearing journals, and flows through those passages to the hydro-dynamically lubricated journal bearings.

Figure 7A:
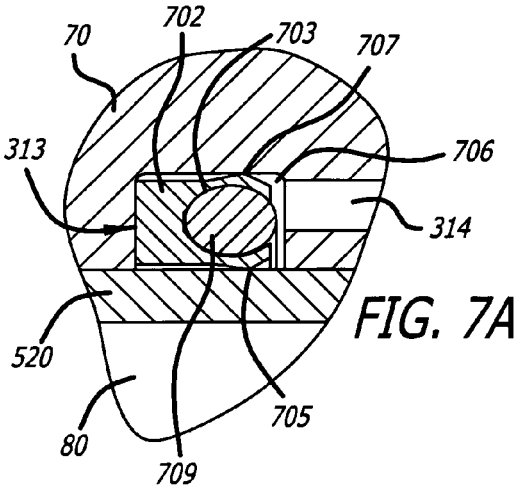
FIG. 7A is an enlarged cross sectional view of a wiper for seating in the inner bore of the cylinder liner of FIG. 3A.

All of the annular wipers of the engine may be constructed and assembled as shown in FIG. 7A, where the annular wiper 313 includes an elastomeric annulus 702 with walls forming a circumferential groove 703. The inside wall of the wiper 313 includes a ramped surface terminating in a circumferential notch 705. The outside wall has a wavy surface including at least one projection 707. During assembly, the inner and outer walls are spread apart and an annular ring 709, such as a steel spring or an elastomeric an O-ring is seated in the groove 703. When the walls are subsequently released, they move against the annular ring 709, squeezing it into an oblong shape and maintaining a spreading force between the walls. With reference to FIGS. 3B and 7A, the outer diameter of the annulus 702 is nominally equal to the inner diameter of the annular wiper grooves 312 in the bore of a cylinder liner 70 near the inlet and exhaust ends. When an end cap 307 is secured to the end of the liner tube 300, the annulus is lodged in the wiper groove between the inner end 311 of the end cap 307 and the raised shoulder 310. The flattened ring 709 exerts a spring force against the inner wall, thereby urging the lower edge of the notch 705 against the outside surface of a piston skirt 520. The projection 707 contacts the floor of the wiper groove 312, thereby resisting displacement of the annulus 702 in a longitudinal direction in the bore of the cylinder liner. Thus seated, the wiper ring 313 grips the outer surface of a piston skirt 520, wiping excess lubricant from the skirt as the piston reciprocates during engine operation. For example, with reference to FIGS. 3B and 7A, during splash lubrication occurring when a piston skirt is withdrawn from a cylinder bore as the piston transits through its bottom dead center position, excess lubricant can be skived from the skirt 520 by the lower edge of the notch 705 and transported over the ring 709 to the end cap 307. The excess lubricant flows over the inner bore of the end cap and out of the exhaust end of the cylinder liner 70, from where it transits to be collected in the sump 129 (FIG. 1B).

Figure 7B:
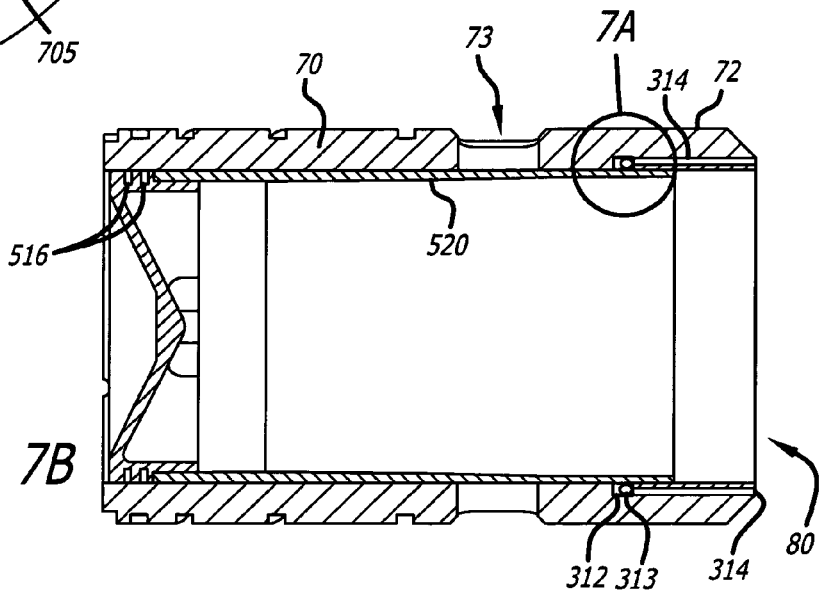
FIG. 7B is a side sectional view of the exhaust side of a cylinder liner showing the position of a wiper with respect to a piston at TDC in the cylinder liner.
Figure 7C:
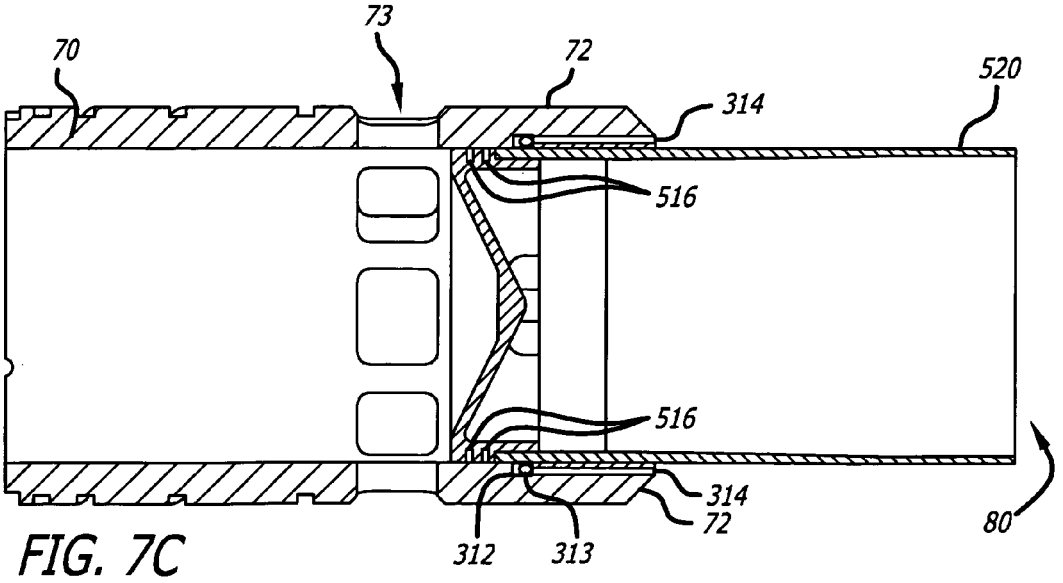
FIG. 7C is a side sectional view of the exhaust side of the cylinder liner showing the position of the wiper with respect to the piston at BDC in the cylinder liner.

With reference to FIGS. 7B and 7C, the wipers 313 are located in the bore of a cylinder liner 70 so as to avoid damage by contact with the compression rings 516 while preventing the transport of lubricant on the outside surface of a piston skirt 520 into an exhaust or inlet port. Preferably, each wiper is located between an exhaust or inlet port and the corresponding end of a cylinder liner. This relationship is illustrated in FIG. 7B, where the wiper 313 is seated in the bore of the cylinder liner between the exhaust port 73 and the exhaust end 72. As the exhaust side piston 80 moves through TDC, the exhaust port 73 is located between the compression rings 516 and the wiper 313. In FIG. 7C, when the piston 80 moves through BDC, the compression rings 516 are located between the exhaust port 73 and the wiper 313. Thus, while the compression rings transit the exhaust port 73 twice each cycle, they do not transit the wiper groove 312 at all.

Figure 8A:
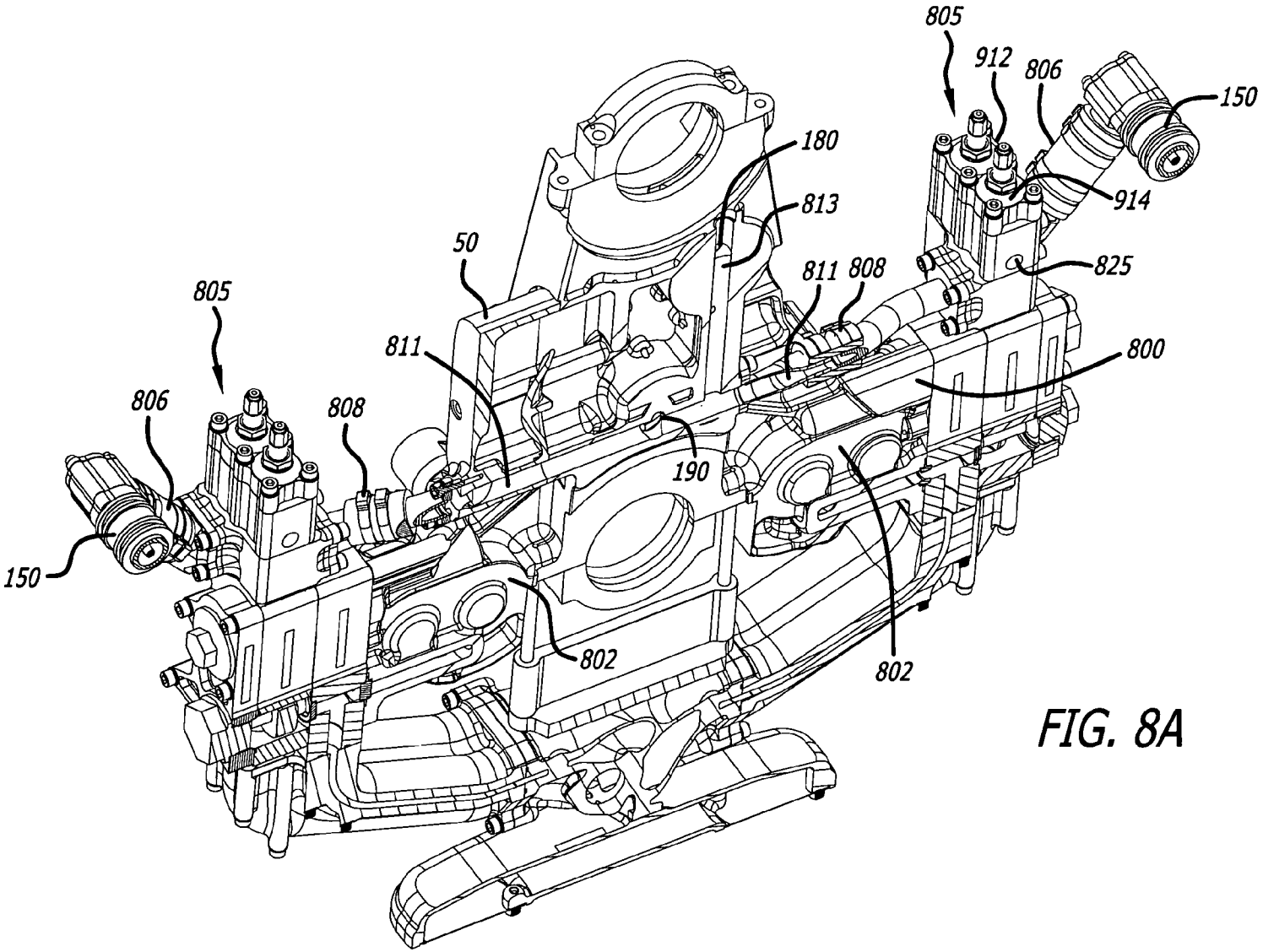
FIG. 8A is a perspective view of a first vertical section of the spar with elements mounted thereto, looking toward a second side of a drive train support structure.
Figure 8B:
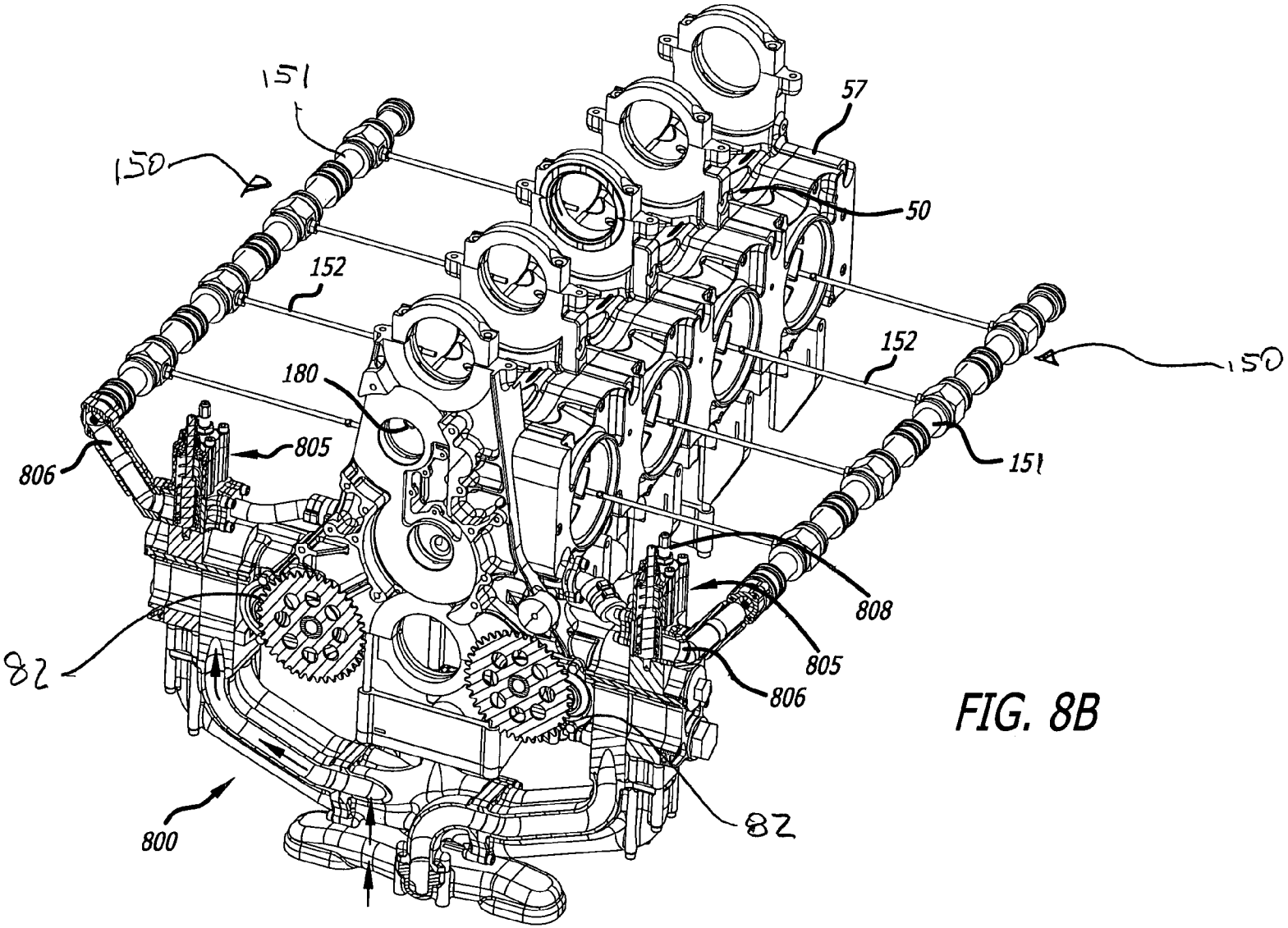
FIG. 8B is a perspective view of the spar with elements mounted thereto, looking toward the first side of the drive train support structure, with certain features cut away.

The engine constructions thus far described provide lubricant delivery structures in which a liquid lubricant, such as oil, provided under pressure by a pumped source, can be distributed throughout a multi-cylinder, opposed piston engine for lubricating bearings, for cooling cylinders, and for lubricating and cooling pistons. Preferably, the pumped source includes two pumps mounted on the spar 50. As per FIG. 2A, the spar 50 includes, at an output end, a drive train support structure 800 with provision for mounting the engine drive train and certain auxiliary components. For example, as seen in FIG. 8A two pumps 802 are integrated into opposing sides of the support structure 800. Now, with reference to FIGS. 8A and 8B, a liquid lubricant is delivered, under pressure, to the upper and lower lubricant distribution galleries 180 and 190, and to the piston coolant manifolds 150 by the two pumps. As best seen in FIG. 8B the pumps 802 are driven by drive train gears 803, 804, and each pumps lubricant collected in the sump from the sump, into a control mechanism 805. From a control mechanism, pumped lubricant flows through a coupling 806, into a piston coolant manifold 150. Each control mechanism 805 also provides pumped lubricant through a coupling 808 into a delivery passage 811 bored in the spar 50 that is transverse to the spar's longitudinal direction. The lower lubricant distribution gallery 190 opens into the transverse passage 811 as does a riser passage 813 bored in the spar which extends to the upper lubricant distribution gallery 180.

As best seen in FIGS. 8B and 5C, the pumped lubricant flows through the piston coolant manifolds 150, out through the piston coolant jets 152, and into the piston rods 82. In each piston the lubricant is distributed in turbulent streams, with radial symmetry, through the wedge-shaped notches 551 that impinge on and cool the back of the crown 510. As taught in U.S. Pat. No. 7,360,511, rotationally symmetrical delivery of streams of liquid coolant directed at the back surface of the crown 510 assures uniform cooling of the crown during engine operation and eliminates, or substantially reduces, swelling of the crown and the portion of the skirt immediately adjacent the crown during engine operation. The lubricant flows from the notches 551 along the inner surface 522 of the piston skirt 520, and out the open end of the skirt. Exiting the skirt, the lubricant is thrown about and scattered by the movement of the piston 80, the pin 84 attached to the piston, and the connecting rods 100, 110 coupled to the pin 84. The scattered lubricant is splashed onto the outside surface of the piston skirt 520 and onto the bearings with which the connecting rods 100, 110 are coupled to the pin 84. With reference to FIG. 3B, excess lubricant transported on the outside surface of the skirt 520 is skived off the outside surface by wipers 313 and channeled out of the ends of the cylinder liner 70 by discharge grooves 314, whence it is thrown into the mist of splashed oil. Thus, lubricant that is pumped to the pistons is employed for both cooling the piston crowns and splash lubrication of the piston skirt outer surfaces and connecting rod bearings. The engine covers 35, 36 confine the scattered and splashed lubricant in the engine space occupied by the crankshafts (the engine crank space).

With reference to FIG. 2E, lubricant that is provided under pressure by the pumps 802 flows through the upper and lower lubricant distribution galleries 180 and 190. As seen in FIG. 2F, from the upper gallery 180, the lubricant flows into the lubricant feed passages 182 to feed grooves 64 of the upper main bearings 60. As illustrated in FIG. 6, in each main bearing 60, the lubricant enters the lubricant feed groove 64 from a lubricant feed passage at the portion of the bearing where the maximum pressure is brought to bear by the crankshaft in response to the tensile forces exerted by the crankshafts. That portion is centered on the midpoint of the semicircle supported by the pedestal 61. From that portion, the lubricant travels in opposite directions in the feed groove 64, until it reaches the portion of the main bearing 60 where the minimum pressure is brought to bear by the crankshaft. The minimal pressure portion is spaced circumferentially 180° around the bearing from the maximum pressure portion. The maximum pressure portion is centered on the midpoint of the semicircle defined by the outer piece 62. From there, the lubricant passes through the opening 65 in the bearing sleeve. Some of the lubricant exiting the feed groove is transported throughout, and lubricates the interface between, the crankshaft main journal and the inner surface of the bearing sleeve; some is received into the drilled passages in the crankshaft and transported thereby to the hydro-dynamically lubricated bearing interfaces between the crank throws and ends of the connecting rods 100, 110. Lubricant flows continually from those interfaces to be thrown into the mist of splashed lubricant in the engine crankcase.

As seen in FIGS. 2F and 2G, from the lower gallery 190, the lubricant also flows into the lubricant feed passages 192 to feed grooves 64 of the lower main bearings 60 from where lubrication of the lower crankshaft 16 and bearings coupled thereto is accomplished in the manner described in connection with the upper main bearings. In addition, the lubricant flows from the lower gallery 190 into the coolant feed passages 194 and then, as seen in FIGS. 3C and 3D, into the circumferential coolant feed grooves 195 of the through bores 54. Lubricant enters a through bore feed groove 195 (FIG. 2F), against the non-apertured portion 330 of a split collar 327 (FIG. 3A). With reference to FIG. 3A, the flow of lubricant splits into two streams that flow clockwise and counterclockwise along one face of the split collar 327 in the direction of the split 329. The uniform increase in the size of the holes 328 from 330 to 329 in both directions equalizes the rate at which lubricant flows through the split collar 327 into the trench 315 and then the circumferential groove 317. From the circumferential groove 317 lubricant flows into the longitudinal grooves 318 toward the exhaust end 72 and also into the longitudinal grooves 319 toward the inlet end 74. The flow of lubricant in the longitudinal grooves 318 and 319 cools the cylinder liner asymmetrically, delivering more cooling capacity from the center toward the exhaust side of the liner than toward the inlet side. As taught in U.S. Pat. No. 7,360,511, the end portion of the cylinder liner 70 with the exhaust port 73 experiences a greater heat load than the end portion with the inlet port 75, and thus minimizes non-uniformities in the temperature of the cylinder liner and resulting cylindrical non-uniformity of the liner bore. However, the construction of the coolant delivery elements 315, 317, 318, 319, and 327 yields a cylinder liner that is much easier and less expensive to construct than the corresponding arrangement taught in U.S. Pat. No. 7,360,511. Further, the combination of tailored asymmetrical cooling of the cylinder liner 70 and radially symmetrical cooling of the pistons 80 that it contains eliminates non-uniform distortion of the cylinder liner and expansion of the piston crowns, and thereby maintains a substantially constant and circularly symmetrical mechanical clearance between the bore of the cylinder and the pistons during engine operation.

Continuing with the description of the cylinder coolant flow with reference to FIGS. 3A and 3D, lubricant flows out the ends 320 of the longitudinal grooves 318, into the through bore coolant collector groove 342 (seen in FIG. 3C), and out of the spar 50 through one coolant drain passage 196. Lubricant flows out the ends 321 of the longitudinal grooves 319 into the through bore coolant collector groove 344 (seen in FIG. 3C), and out of the spar 50 through another coolant drain passage 196. Lubricant flows continually from the coolant drain passages along the top of the spar 50, whence it is thrown into the mist of splashed oil in the engine.

Lubricant splashed about the engine crank space continually rains to the bottom of the engine and flows into the sump 129, from which it is pumped and delivered as described above for lubrication and cooling. The described engine constructions preferably include a control mechanization to manage the delivery of pumped lubricant for lubrication and cooling through the lubricant distribution galleries and the piston coolant manifolds described above and represented in schematic form in FIG. 9.

Figure 9:
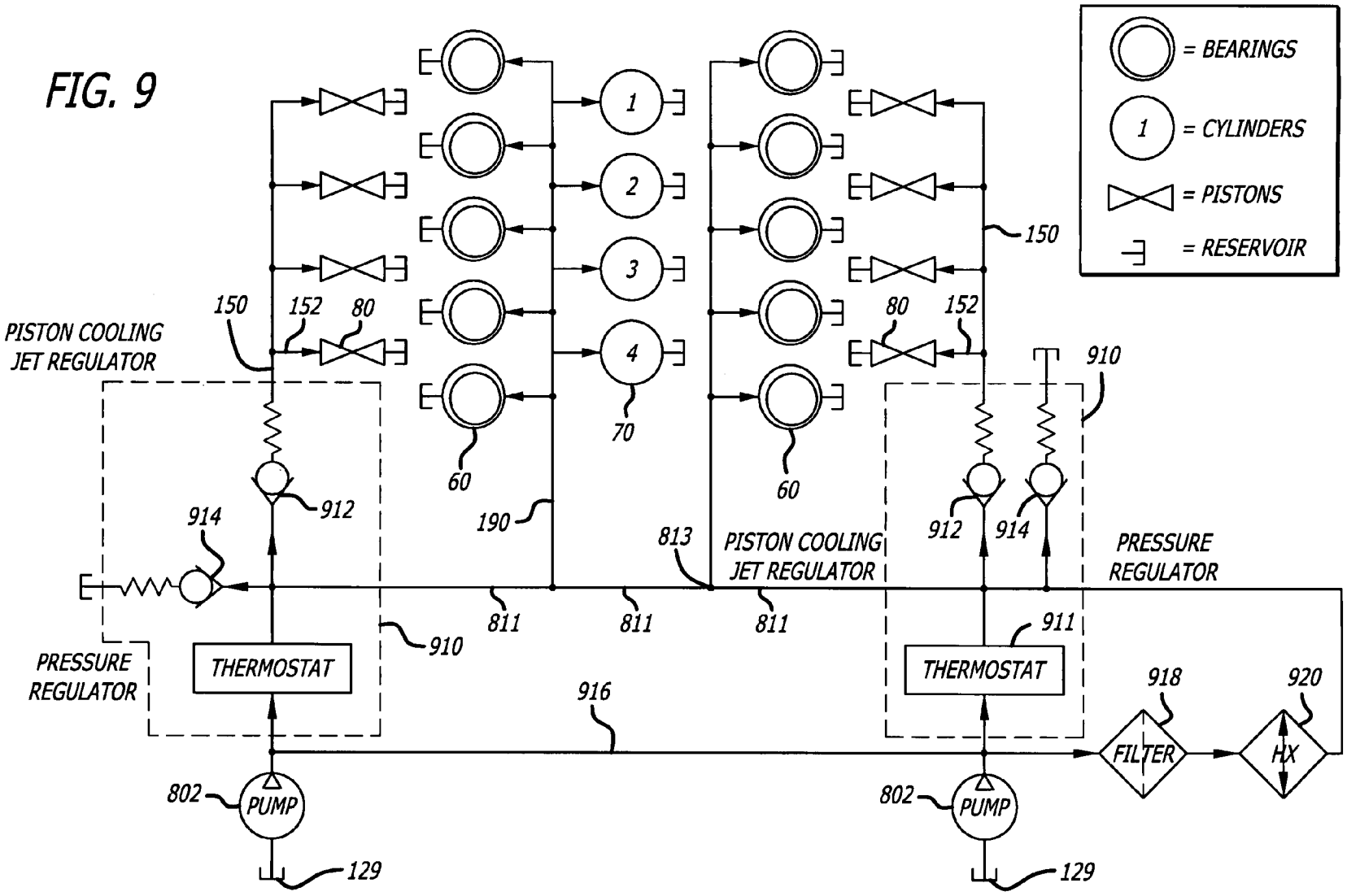
FIG. 9 is a schematic drawing showing a control mechanization that regulates and manages the provision of lubricant for lubrication and cooling in the engine of FIG. 1A.

As per FIG. 9, delivery of the lubricant outputs of the pumps 802 is controlled by integrated control subsystems. Each control subsystem may be self-actuating, or may be actuated by way of an electronic control unit. For example, the self-actuating control subsystems 910 illustrated in FIG. 9 include a thermostat valve 911, a piston cooling regulator valve 912, and a pressure relief valve 914. The outputs of the pumps 802 are connected, in series, to a cooling line 916 wherein the lubricant is cooled. Preferably, the cooling line 916 includes a filter 918 and a heat exchanger 920 connected in series, although other cooling elements may be used. The cooling line 916 is connected through one pump 802 to the passage bore 811 in the spar 50, in common with the valves 912 and 914. The passage bore 811 is connected to the other pump assembly 802, in common with the valves 912 and 914 of that assembly. When open, a thermostat valve 911 shunts the output of a hydraulic pump 802 over the cooling line 916 to the passage bore 811.

In the control mechanization of FIG. 9, the thermostat valves 911 respond to the temperature of the lubricant, and the valves 912 and 914 respond to the fluid pressure of the lubricant. When the lubricant temperature T is less than a first predetermined level $T_L$ (a minimum temperature, in other words), the thermostat valves 911 open and shunt lubricant across the cooling line 916 to the passage bore 811. When the temperature of the lubricant attains a second predetermined level $T_H$, a maximum temperature which is greater than $T_L$, the thermostat valves 911 shut and force lubricant to flow through the cooling line 916, the filter 918, and the heat exchanger 920. From the heat exchanger 920, filtered, cooled lubricant flows back through the cooling line 916 and into the passage bore 811. The valves 912 and 914 remain closed for so long as a fluid pressure P has not attained a first predetermined (minimum) level, $P_L$. When the first predetermined level $P_L$ is attained, the piston cooling regulator valves 912 open while the pressure relief valves 914 remain shut.

When fluid pressure reaches a predetermined relief level $P_H$, the pressure relief valves open. Finally, the thermostat valves 911 may also respond to fluid pressure and open when fluid pressure reaches a maximum allowable pressure level $P_{HH}$ which exceeds $P_H$. Thus, per Table I,

TABLE I

| | $P < P_L$ | $P_H > P > P_L$ | $P > P_H$ | $P = P_{HH}$ |
|---|---|---|---|---|
| $T < T_L$ | S | SJ | SJB | SJB |
| $T > T_H$ | SH | SJH | SJBH | SJB |

where P is lubricant fluid pressure, T is lubricant temperature, S=spar 50, J=piston cooling Jets 152, B=Bypass via valves 914, and H=transport of lubricant through the cooling line 916, the Heat exchanger 920, and the filter 918.

According to Table I, under engine start up and operation when the lubricant is relatively cool ($T<T_L$), and the pressure is low ($P<P_L$), the thermostat valves 911 are open, shunting the lubricant across the cooling line, directly to the passage bore 811 in the spar 50. However, when the engine starts, the pumps 820 might not be fully primed, and lubricant flow may be insufficient to ensure adequate flow to the main bearings, which require immediate lubrication, and to the cylinder liners, which require immediate cooling, as well as to the pistons. Thus, in order to ensure viability of the main bearings and cylinder liners before fluid pressure builds to a level adequate to ensure that all lubrication and cooling needs are served, the piston cooling valves 912 remain closed, preventing lubricant from flowing to the piston cooling manifolds 150. Once the pumps and lubricant passages are primed and fluid pressure reaches $P_L$, the piston cooling regulator valves 912 open, permitting lubricant to flow to the piston coolant manifolds 150. The fluid pressure level range $P_L<P<P_H$ which establishes precise magnitudes for $P_L$ and $P_H$ will depend upon a number of factors related to a specific engine designs and constructions. For example, such factors may include lubricant flow requirement to control temperature across the main bearings, pressure required to avoid cavity formation in the crankshaft passages feeding lubricant from the main bearings, lubrication requirements of auxiliary equipment such as turbochargers, sufficiency of piston coolant flow for varying levels of power loading and piston acceleration, sufficiency of cylinder coolant flow for varying levels of power loading, avoidance and/or mitigation of cavity formation at the pump inlets, and the fluid properties of the selected lubricant. As the fluid level reaches $P_H$ the pressure relief valves 914 open, shunting lubricant out of ports into the covered engine space until the fluid pressure drops below $P_H$.

According to Table I, under engine start up and operational conditions when the lubricant is relatively hot ($T>T_H$) the thermostat valves 911 are closed, directing the lubricant through the cooling line 916, the filter 918, and the heat exchanger 920 and then to the passage bore 811 in the spar 50; otherwise, the control mechanization causes the lubricant to be distributed in response to fluid pressure P as disclosed above.

There may be certain failure modes and hazards that can be anticipated and provided for in the control mechanization of FIG. 9. For example, any one or more of the cooling line 916, the filter 918, and the heat exchanger 920 may become obstructed or fail under high temperature conditions, causing pressure to rise. In such a case, as is evident in Table I, when $T_H$ is exceeded and P reaches $P_{HH}$, the thermostat valves 911 again close and shunt the pumped lubricant past the cooling line 916, directly to the passage 811 and the pressure regulator valves 916, thereby avoiding obstruction in the cooling line circuit.

The control mechanization illustrated in FIG. 9 and Table I may be adjusted or adapted to account for non-uniform heating effects on the pistons during engine operation. An adaptation described above is the tailored cooling of the cylinder liners to account for non-uniform heating in which exhaust ends of the liners typically run hotter than intake ends. Correlative adaptations may be made in the control mechanization just described to account for differential heating of the pistons during engine operation. In this regard, the pistons in the exhaust sides of the cylinder liners heat more quickly and typically run hotter than the intake side pistons. Thus, with reference to FIG. 9, the piston coolant regulator valves 912 may be selected to have offset operating points so as to provide lubricant to the piston coolant manifold serving the exhaust side pistons before lubricant is provided to cool the intake side pistons. Thus, the valve 912 controlling the coolant manifold serving the exhaust side pistons would open at a lower fluid pressure than the valve controlling the intake side manifold. Further, the piston coolant regulator valves 912 may be selected to have offset fluid flow limits in order to provide lubricant at a higher flow rate to the exhaust side pistons than to the intake side pistons.

A control mechanization that regulates and manages the distribution of a liquid lubricant for lubricating and cooling the opposed-piston engine constructions taught herein under a range of engine operating conditions is not limited to a self-actuating construction such as is illustrated in FIG. 9. For example a control mechanization may be constituted of an electronic engine control unit (ECU), electronic sensors, and electronically-controlled valves. In this regard, the sensors could be deployed to report lubricant temperature and pressure to the ECU. As temperature and pressure change, the ECU would determine the required lubricant delivery settings and would regulate the flow of pumped lubricant to the distribution galleries and piston cooling manifolds by issuing control signals to the electronically actuated valves.

A representative embodiment of a self-actuating control mechanization such as is illustrated in FIG. 9 may be understood with reference to the figures. Although the embodiment includes two pumps, and two physically separate control entities, this is merely to illustrate underlying principles, but is not meant to so limit the principles. It is expected that control mechanizations that manage the provision of pumped lubricant for lubrication and cooling may be practiced with fewer, and more, than two pumps, and with fewer, and more, than two control entities as determined by specific circumstances.

Figure 8C:
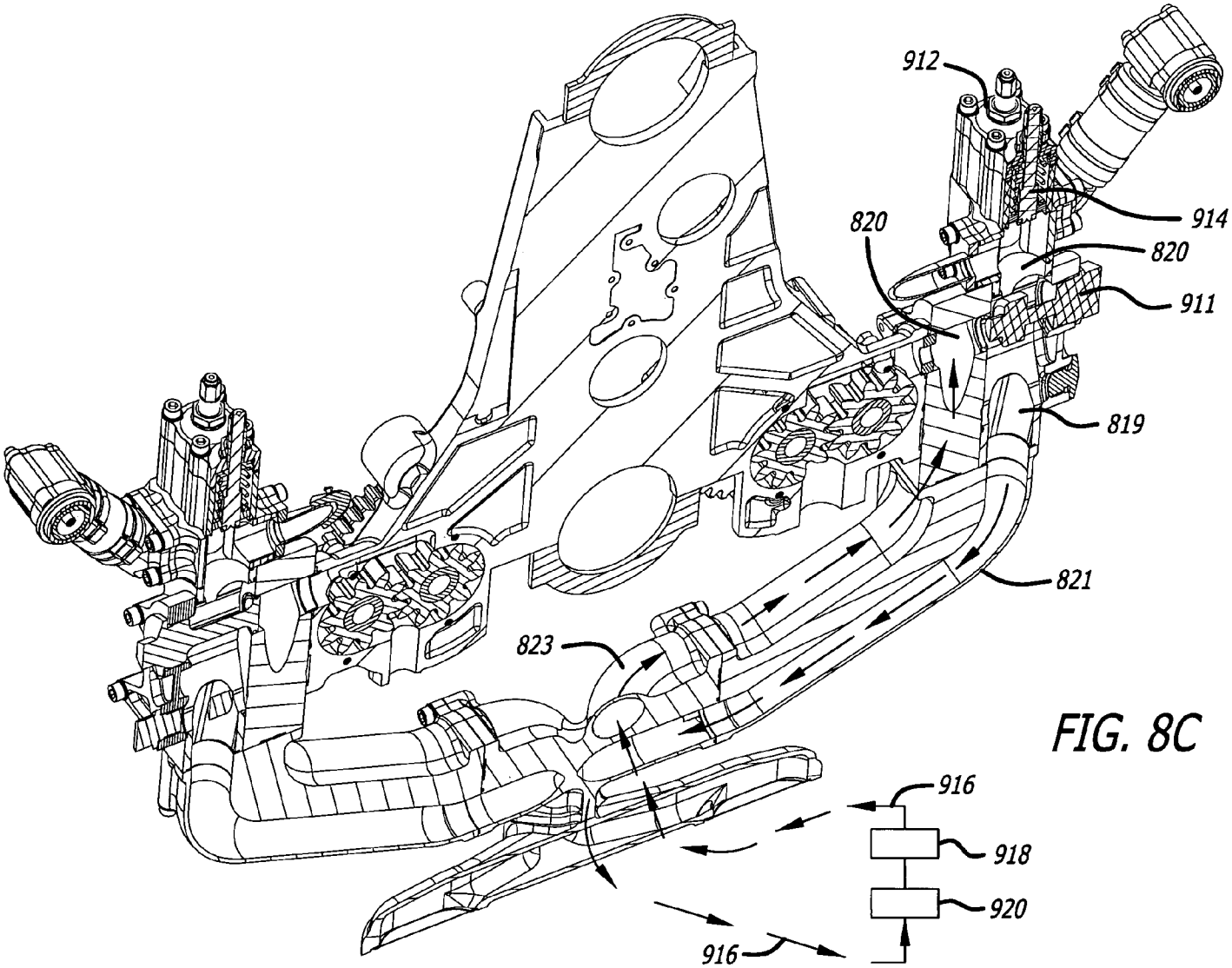
FIG. 8C is a perspective sectional view of the spar, with elements mounted thereto, taken along lines C-C of FIG. 8A.

Referring now to an example understood with reference to certain figures, a pumped source that provides pumped lubricant may include two pumps, each mounted in a respective one of the in recesses 815 (FIG. 2A) in a lower corner of the support structure 800. As illustrated in FIG. 8A, a mechanization that controls the provision of the pumped lubricant for lubricating and cooling elements of an opposed piston engine may include two control mechanisms 805, each control mechanism being constructed to control the output of a respective one of the pumps 802. A pump and an associated control mechanism may be constructed and assembled as shown in FIGS. 8A-8B, where FIG. 8B shows a drive train gear 803 that drives a pump 802 (seen in FIG. 8C) during engine operation. As indicated by the sequence of arrows, the lubricant is pumped from the sump, through an intake pipe 817, to and through the pump 802. As seen in FIG. 8C, the pump 802 delivers pumped lubricant into an intake chamber 819. When the thermostat valve 911 is open, the pumped lubricant flows through the valve 911 into an outlet chamber 820. When the thermostat valve 911 is closed, the pumped lubricant flows out of the intake chamber 817 via a cooling input pipe 821, into the cooling line 916, where it is filtered and cooled at 918 and 920. After filtration and cooling, the pumped lubricant flows from the cooling line 916 into a cooling output pipe 823 into the output chamber 820. From the output chamber 820, the flow of pumped lubricant flows into the passage bore 811 for distribution to lubricate bearings and cool cylinder liners. With reference to FIG. 8A, as the fluid pressure of the lubricant in the output chamber 820 rises, provision of the lubricant to the piston cooling manifolds from the output chamber 820 is controlled, or gated, by the valve 912. As fluid pressure in the output chamber 820 rises above the level specified for bypass, venting the lubricant from the output chamber 820 through a bypass aperture (indicated by reference numeral 825 in FIG. 8A) is controlled, or gated, by the valve 914.

Selection of a liquid lubricant suitable for the engine constructions described and illustrated in this specification should depend upon many factors, including the lubrication requirements for bearings and the cooling requirements of the cylinder liners and pistons. In some aspects, SAE 10W20, SAE15W40, or other lubricating oils may be used.

Figure 10:
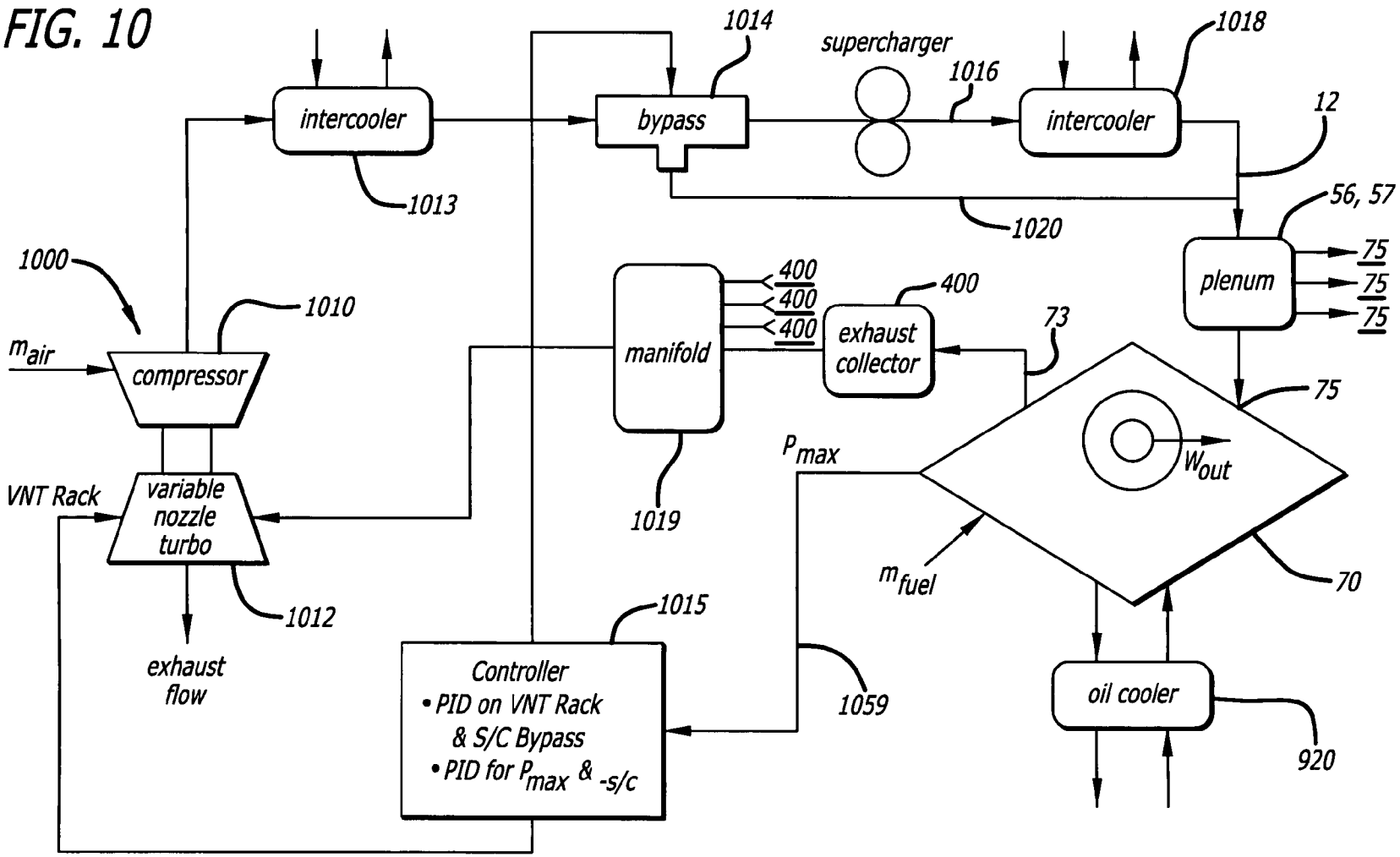
FIG. 10 is a block diagram of an air charge system for use in the engine of FIG. 1A.

FIG. 10 illustrates an air charge system which may be used with the engine constructions described above. In the figure, the air charge system includes a turbocharger 1000 with a compressor 1010 and a variable nozzle turbine 1012. Intake air is drawn into the compressor 1010 and compressed. The hot, compressed air is cooled in a first intercooler 1013 after which it passes through a bypass valve 1014 controlled by a controller 1015. The air is then further compressed by a supercharger 1016 and the resulting hot, compressed air is cooled by a second intercooler 1018. Pressurized air is passed from the second intercooler 1018 through the air inlet adapter 12 into the plenum chamber 56, 57, wherein the inlet port 75 of each cylinder liner 70 is positioned. The pressurized air in the plenum chamber 56, 57 is provided to the inlet ports 75 of all of the cylinder liners 70 at a substantially uniform pressure to ensure substantially uniform combustion and scavenging in the among the cylinder liners 70 throughout engine operation. Preferably, exhaust gasses from each individual cylinder liner 70 are fed through an exhaust collector 400 into a manifold 1019. The exhaust gasses then pass through the variable nozzle turbine 1012 of the turbocharger 1000 in response to signals from the controller 1015.

Although opposed piston engine constructions have been described in detail with reference to specific embodiments, it should be understood that various modifications can be made without departing from the principals underlying those embodiments. Accordingly, an invention embracing those principals should be limited only by the following claims. Further, the scope of the novel engine constructions described and illustrated herein may suitably comprise, consist of, or consist essentially of more or fewer elements than those described. Further, the novel engine constructions disclosed and illustrated herein may also be practiced in the absence of any element which is not specifically disclosed in the specification, illustrated in the drawings, and/or exemplified in the embodiments of this application.

The invention claimed is:

1. An opposed piston engine, comprising:

an elongate longitudinal member;

a plurality of cylinder liners supported in the elongate longitudinal member, each having an internal bore;

a pair of opposed pistons disposed in the internal bore of each liner;

main bearings supported on the elongate longitudinal member, the main bearings rotatably supporting at least one crankshaft;

a lubricant distribution gallery in the elongate longitudinal member and in fluid communication with coolant passages extending around the cylinder liners and with inlet passages leading to the main bearings;

one or more piston cooling manifolds in fluid communication with piston coolant jets;

a pumped lubricant source connected to the lubricant distribution gallery and to the one or more piston cooling manifolds; and, a control mechanization responsive to at least one engine operating condition to selectively block pumped lubricant to the one or more piston cooling manifolds while providing pumped lubricant to the lubricant distribution gallery when the engine starts, and to provide pumped lubricant to the one or more piston cooling manifolds and to the lubricant distribution gallery thereafter.

2. The opposed piston engine of claim 1, wherein the at least one engine operating condition is fluid pressure of the lubricant.

3. The opposed piston engine of claim 1, wherein the at least one engine operating condition is temperature of the lubricant.

4. The opposed piston engine of claim 3, wherein the at least one engine operating condition includes fluid pressure of the lubricant and temperature of the lubricant.

5. The opposed piston engine of claim 1, wherein the control mechanization is responsive to at least one engine operating condition to block pumped lubricant to a first piston cooling manifold while providing pumped lubricant to a second piston cooling manifold.

6. The opposed piston engine of claim 5, wherein the at least one engine operating condition is fluid pressure of the lubricant.

7. The opposed piston engine of claim 5, wherein the at least one engine operating condition is temperature of the lubricant.

8. The opposed piston engine of claim 1, wherein:

the main bearings rotatably supporting at least one crankshaft include first main bearings rotatably supporting a first crankshaft and second main bearings supporting a second crankshaft; and, the lubricant distribution gallery includes a first distribution gallery in a first portion of the elongate longitudinal member and in fluid communication with first inlet passages leading to the first main bearings and a second distribution gallery in a second portion of the elongate longitudinal member and in fluid communication with the coolant passages extending around the cylinder liners and with second inlet passages leading to the second main bearings.

9. The opposed piston engine of claim 8, wherein the at least one engine operating condition is fluid pressure of the lubricant.

10. The opposed piston engine of claim 9, wherein the at least one engine operating condition is temperature of the lubricant.

11. The opposed piston engine of claim 10, wherein the at least one engine operating condition includes fluid pressure of the lubricant and temperature of the lubricant.

12. The opposed piston engine of claim 1, wherein the pistons include inlet pistons and exhaust pistons, and wherein the control mechanization is responsive to at least one engine operating condition to block pumped lubricant to a piston cooling manifold for inlet pistons while providing pumped lubricant to a piston cooling manifold for exhaust pistons.

13. A method of operating an opposed piston engine having an elongate longitudinal member, a plurality of cylinders supported in parallel with one another in the elongate longitudinal member between a pair of crankshafts, and having a pair of opposed pistons disposed in a bore of each cylinder, each piston being coupled to both crankshafts, the method comprising: supplying an inlet stream of lubricant through a lubrication distribution gallery in the elongate longitudinal member that is in fluid communication with bearing lubricant passages and cylinder coolant passages; and, preventing lubricant from flowing from the inlet stream of lubricant into at least one piston coolant manifold in response to a first engine operating condition when the engine starts; wherein providing lubricant from the inlet stream of lubricant into at least one piston coolant manifold in response to a first engine operating condition includes: blocking lubricant to a first piston cooling manifold while providing pumped lubricant to a second piston cooling manifold in response to a first value of the condition; and, providing blocking lubricant to both the first and second piston cooling manifolds in response to a second value of the condition.

14. The method of operating an opposed piston engine of claim 13, wherein the first engine operating condition is fluid pressure of the inlet stream of lubricant.

15. The method of operating an opposed piston engine of claim 13, further including diverting the inlet stream of lubricant through a cooling line in response to a second engine operating condition.

16. The method of operating an opposed piston engine of claim 15, wherein the first engine operating condition is fluid pressure of the inlet stream of lubricant and the second engine operating condition is temperature of the inlet stream of lubricant.

17. A method of operating an opposed piston engine having an elongate longitudinal member, a plurality of cylinders supported in parallel with one another in the elongate longitudinal member between a pair of crankshafts, and having a pair of opposed pistons disposed in a bore of each cylinder, each piston being coupled to both crankshafts, the method comprising: supplying an inlet stream of lubricant through a lubrication distribution gallery in the elongate longitudinal member that is in fluid communication with bearing lubricant passages and cylinder coolant passages; and, preventing lubricant from flowing from the inlet stream of lubricant into at least one piston coolant manifold in response to a first engine operating condition when the engine starts; wherein providing lubricant from the inlet stream of lubricant into at least one piston coolant manifold in response to a first engine operating condition includes: blocking lubricant to a piston cooling manifold for inlet pistons while providing pumped lubricant to a piston cooling manifold exhaust pistons in response to a first value of the condition; and, providing blocking lubricant to both piston cooling manifolds in response to a second value of the condition.

18. The method of operating an opposed piston engine of claim 17, wherein the first engine operating condition is fluid pressure of the inlet stream of lubricant.

19. The method of operating an opposed piston engine of claim 17, further including diverting the inlet stream of lubricant through a cooling line in response to a second engine operating condition.

20. The method of operating an opposed piston engine of claim 19, wherein the first engine operating condition is fluid pressure of the inlet stream of lubricant and the second engine operating condition is temperature of the inlet stream of lubricant.

* * * * *